US005396911A

United States Patent [19]

Casey, III et al.

[11] Patent Number: 5,396,911

[45] Date of Patent: * Mar. 14, 1995

[54] SUBSTRATE MATERIAL FOR SMOKING ARTICLES

[75] Inventors: William J. Casey, III, Clemmons; Jeffery S. Gentry, Pfafftown; Alvaro Gonzalez-Parra, Clemmons; Aju N. Lekwauwa, Winston-Salem; Dennis M. Riggs, Belews Creek; Gary R. Shelar, Greensboro; Kenneth W. Swicegood, Lexington; Ronald O. Wagoner, Winston-Salem; Jeffrey A. Willis, Germanton; Walter R. D. Young, Jr., Winston-Salem, all of N.C.

[73] Assignee: R. J. Reynolds Tobacco Company, Winston-Salem, N.C.

[ * ] Notice: The portion of the term of this patent subsequent to Apr. 7, 2009 has been disclaimed.

[21] Appl. No.: 800,679

[22] Filed: Nov. 27, 1991

Related U.S. Application Data

[63] Continuation-in-part of Ser. No. 567,519, Aug. 15, 1990, Pat. No. 5,101,839.

[51] Int. Cl.[6] ..... A24B 15/16

[52] U.S. Cl. ..... 131/352; 131/194; 131/335; 131/343

[58] Field of Search ..... 131/335, 343, 194, 365, 131/352, 356, 359

[56] References Cited

U.S. PATENT DOCUMENTS 2,592,553 4/1952 Frankenburg et al. .
2,592,554 4/1952 Frankenburg .
2,598,680 6/1952 Frankenburg .
2,769,734 7/1955 Bandel .
2,907,686 10/1959 Siegel .
3,000,764 9/1961 Drucker ..... 131/17
3,042,552 3/1962 Rosenberg ..... 131/17
3,098,492 7/1963 Wurzburg et al. .
3,112,754 12/1963 Diaz .
3,141,462 9/1961 Block et al. .
3,353,541 11/1967 Hind et al. ..... 131/17
3,364,935 1/1968 Moshy et al .
3,386,449 6/1968 Hind et al. ..... 131/140
3,395,714 8/1968 Kahane et al. .
3,404,691 10/1968 Moshy et al. .
3,410,279 11/1968 Moshy et al. .

(List continued on next page.)

FOREIGN PATENT DOCUMENTS 0056308 7/1982 European Pat. Off. .
0236992A 9/1987 European Pat. Off. ..... A24B 15/16

(List continued on next page.)

OTHER PUBLICATIONS

Translation of German Preliminary Published Application DE 39 08 161A1.

(List continued on next page.)

*Primary Examiner*—V. Millin
*Assistant Examiner*—W. Pierce
*Attorney, Agent, or Firm*—Grover M. Myers; David G. Conlin

[57] ABSTRACT

Disclosed is a stabilized substrate composition for smoking articles, particularly cigarettes. In general, the stabilized substrate composition comprises an admixture of a binder and an aerosol forming material which plasticizes the binder, together with optional fillers and/or base materials. In the stabilized substrate compositions of the present invention the relative amounts of binder and aerosol former depend particularly on the situation in which the substrate composition is used. In general, the ratio of aerosol former to binder is between about 3:1 and about 40:1. When the stabilized composition is used on a base material such as tobacco cut filler, the ratio of aerosol former to binder should be at least about 15:1, and preferably is from about 25–35:1, with a maximum ratio of about 40:1. If the composition is formed into a cast sheet, the minimum ratio is about 3:1, the preferred ratio is about 8:1, and the maximum ratio is about 10:1. When the stabilized mixture is printed on a sheet or web substrate, the ratio of aerosol former to binder is generally about 6:1, the maximum ratio is about 10:1, and the minimum ratio is about 3:1.

72 Claims, 2 Drawing Sheets

U.S. PATENT DOCUMENTS

| | | | |
|---|---|---|---|
| 3,420,241 | 1/1969 | Hind et al. | 131/140 |
| 3,511,247 | 5/1970 | Tamol . | |
| 3,526,904 | 9/1970 | Tamol . | |
| 3,608,560 | 9/1971 | Briskin et al. . | |
| 4,802,568 | 2/1989 | Haarer et al. | 198/388 |
| 4,807,809 | 2/1989 | Pryor et al. | 131/84.1 |
| 4,819,665 | 4/1989 | Roberts et al. | 131/195 |
| 4,821,749 | 4/1989 | Toft et al. | 131/575 |
| 4,827,950 | 5/1989 | Banerjee et al. | 131/335 |
| 4,854,331 | 8/1989 | Banerjee et al. | 131/194 |
| 4,858,630 | 8/1989 | Banerjee et al. | 131/364 |
| 4,870,748 | 10/1989 | Hensgen et al. | 29/773 |
| 4,874,000 | 10/1989 | Tamol et al. . | |
| 4,881,556 | 11/1989 | Clearman et al. | 131/359 |
| 4,887,618 | 12/1989 | Bernasek et al. | 131/297 |
| 4,889,143 | 12/1989 | Pryor et al. | 131/331 |
| 4,893,637 | 1/1990 | Hancock et al. | 131/280 |
| 4,893,639 | 1/1990 | White | 131/369 |
| 4,903,714 | 2/1990 | Barnes et al. | 131/194 X |
| 4,913,169 | 4/1990 | Templeton | 131/194 |
| 4,917,128 | 4/1990 | Clearman et al. | 131/194 X |
| 4,924,888 | 5/1990 | Perfetti et al. . | |
| 4,928,714 | 5/1990 | Shannon | 131/359 |
| 4,936,920 | 6/1990 | Keritsis et al. | 131/78 |
| 4,938,238 | 7/1990 | Barnes et al. | 131/365 |
| 4,941,483 | 7/1990 | Ridings et al. | 131/194 |
| 4,941,484 | 7/1990 | Clapp et al. | 131/297 |
| 4,942,888 | 7/1990 | Montoya et al. . | |
| 4,962,774 | 10/1990 | Thomasson et al. | 131/309 |
| 4,986,286 | 1/1991 | Roberts et al. | 131/290 |
| 4,987,906 | 1/1991 | Young et al. | 131/297 |
| 4,989,619 | 2/1991 | Clearman et al. | 131/194 |
| 4,991,596 | 2/1991 | Lawrence et al. | 131/194 |
| 4,991,606 | 2/1991 | Serrano et al. | 131/194 X |
| 5,005,593 | 4/1991 | Fagg | 131/297 |
| 5,025,812 | 6/1991 | Fagg et al. | 131/297 |
| 5,025,814 | 6/1991 | Raker | 131/331 |
| 5,027,837 | 7/1991 | Clearman et al. | 131/359 |
| 5,038,802 | 8/1991 | White et al. | 131/297 |
| 5,069,231 | 12/1991 | Rutherford | 131/335 |
| 5,105,836 | 4/1992 | Grentry et al. | 131/359 |
| 5,105,837 | 4/1992 | Barnes et al. | 131/365 |
| 3,633,589 | 1/1972 | Kahane et al. . | |
| 3,638,660 | 2/1972 | Davis . | |
| 3,699,973 | 10/1972 | Tamol et al. . | |
| 3,705,588 | 12/1972 | Tamol et al. . | |
| 3,744,496 | 7/1973 | McCarty et al. . | |
| 3,805,799 | 4/1974 | Stewart et al. . | |
| 3,885,574 | 5/1975 | Borthwick et al. . | |
| 3,911,932 | 10/1975 | Houck, Jr. et al. . | |
| 3,950,179 | 4/1976 | Schneider | 106/208 |
| 3,983,884 | 10/1976 | Detert et al. . | |
| 4,019,520 | 4/1977 | Strubel et al. . | |
| 4,044,777 | 8/1977 | Hoyd et al. . | |
| 4,225,636 | 9/1980 | Cline et al. . | |
| 4,231,377 | 11/1980 | Cline et al. . | |
| 4,286,604 | 9/1981 | Ehretsmann et al. . | |
| 4,326,544 | 4/1982 | Hardwick et al. . | |
| 4,333,484 | 6/1982 | Keritsis . | |
| 4,341,228 | 7/1982 | Keritsis et al. . | |
| 4,347,855 | 9/1982 | Lanzillotti et al. | 131/78 |
| 4,407,308 | 10/1983 | Baker et al. . | |
| 4,453,553 | 6/1984 | Cohn . | |
| 4,461,311 | 7/1984 | Mathews et al. . | |
| 4,485,829 | 12/1984 | Rainer et al. | 131/291 |
| 4,489,738 | 12/1984 | Simon . | |
| 4,505,282 | 3/1985 | Cogbill et al. . | |
| 4,506,682 | 3/1985 | Muller | 131/297 |
| 4,506,684 | 3/1985 | Keritsis . | |
| 4,510,950 | 4/1985 | Keritsis et al. . | |
| 4,561,454 | 12/1985 | Guess . | |
| 4,607,647 | 8/1986 | Dashley et al. . | |
| 4,624,268 | 11/1986 | Baker et al. . | |
| 4,625,737 | 12/1986 | Keritsis et al. . | |
| 4,691,717 | 9/1987 | Ikeda et al. . | |
| 4,700,726 | 10/1987 | Townsend et al. . | |
| 4,708,151 | 11/1987 | Shelar | 131/359 |
| 4,714,082 | 12/1987 | Banerjee et al. | 131/359 |
| 4,732,168 | 3/1988 | Resce et al. | 131/359 |
| 4,756,318 | 7/1988 | Clearman et al. | 131/359 |
| 4,771,795 | 9/1988 | White et al. | 131/194 |
| 4,779,631 | 10/1986 | Durocher et al. | 131/365 |
| 4,782,644 | 11/1988 | Haarer et al. | 53/282 |
| 4,793,365 | 12/1988 | Sensabaugh, Jr. et al. | 131/194 |

FOREIGN PATENT DOCUMENTS

| | | | |
|---|---|---|---|
| 167370 | 3/1988 | European Pat. Off. . | |
| 00304766A | 3/1989 | European Pat. Off. | A24F 47/00 |
| 0338831A | 10/1989 | European Pat. Off. | A24B 15/24 |
| 0339690A | 11/1989 | European Pat. Off. | A24D 1/18 |
| 0342538A | 11/1989 | European Pat. Off. | A24F 47/00 |
| 0407792A | 1/1991 | European Pat. Off. | A24F 47/00 |
| 0419974 | 4/1991 | European Pat. Off. . | |
| 0419975 | 4/1991 | European Pat. Off. . | |
| 0509657A | 10/1992 | European Pat. Off. . | |
| 0509657 | 10/1992 | European Pat. Off. . | |
| 1185887 | 2/1982 | United Kingdom . | |
| 2143150A | 2/1985 | United Kingdom | A42D 1/100 |

OTHER PUBLICATIONS

Chemical and Biological Studies of New Cigarette Prototypes that Heat Instead of Burn Tobacco, R. J. Reynolds Tobacco Co., (1988).

Tobacco Encyclopedia, edited by Voges, p. 389, TJI (1984).

*The Technology of Solvents and Plasticizers,* Chapter 15, "Plasticizers and plasticization," John Wiley & Sons, N.Y. (1954).

*Tobacco Substitutes,* Noyes Data Corp. (1976).

Leffingwell et al. *Tobacco Flavoring for Smoking Product* (1972).

SUBSTRATE MATERIAL FOR SMOKING ARTICLES

CROSS-REFERENCE TO RELATED APPLICATIONS

This application is a continuation-in-part of application Ser. No. 07/567,519, filed Aug. 15, 1990, now U.S. Pat. No. 5,101,839, the disclosure of which is hereby incorporated herein by reference.

FIELD OF THE INVENTION

The present invention is directed to improvements in smoking articles, particularly smoking articles employing tobacco therein. Cigarettes, cigars and pipes are popular smoking articles which use tobacco in various forms. Many smoking products have been proposed as improvements upon, or alternatives to, the various popular smoking articles. For example, numerous references have proposed articles which generate a flavored vapor and/or a visible aerosol. Most of such articles have employed a combustible fuel source to provide an aerosol and/or to heat an aerosol forming material. See, for example, the background art cited in U.S. Pat. No. 4,714,082 to Banerjee et al.

BACKGROUND OF THE INVENTION

The present invention relates to smoking articles such as cigarettes, and in particular to those smoking articles having a short fuel element and a physically separate aerosol generating means. Smoking articles of this type, as well as materials, methods and/or apparatus useful therein and/or for preparing them, are described in the following U.S. Pat. Nos. 4,708,151 to Shelar; 4,714,082 to Banerjee et al.; 4,732,168 to Resce; 4,756,318 to Clearman et al.; 4,782,644 to Homer et al.; 4,793,365 to Sensabaugh et al.; 4,802,562 to Homer et. al.; 4,827,950 to Banerjee et al.; 4,870,748 to Hensgen et al.; 4,881,556 to Clearman et al.; 4,893,637 to Hancock et al.; 4,893,639 to White; 4,903,714 to Barnes et al.; 4,917128 to Clearman et al.; 4,928,714 to Shannon; 4,938,238 to Hancock et al., 4,989,619 to Clearman et al., 5,027,837 to Clearman et al., and 5,038,802 to White et al., as well as in the monograph entitled *Chemical and Biological Studies of New Cigarette Prototypes That Heat Instead of Burn Tobacco,* R. J. Reynolds Tobacco Company, 1988 (hereinafter "RJR Monograph"). These smoking articles are capable of providing the smoker with the pleasures of smoking (e.g., smoking taste, feel, satisfaction, and the like). Such smoking articles also typically provide low yields of visible sidestream smoke as well as low yields of FTC tar when smoked.

The smoking articles described in the aforesaid patents and/or publications generally employ a combustible fuel element for heat generation and an aerosol generating means, positioned physically separate from, and typically in a heat exchange relationship with the fuel element. Many of these aerosol generating means employ a substrate or carrier for one or more aerosol forming materials, e.g., polyhydric alcohols, such as glycerin. As the substrate material is heated by the burning of the fuel element, the aerosol forming materials are volatilized and released therefrom to form an aerosol.

The substrates used previously have included heat stable materials, i.e., materials which do not burn or decompose appreciably when subjected to the heat generated by the burning fuel element. Such materials include adsorbent carbons, such as porous grade carbons, graphite, activated carbons, or non-activated carbons, and the like. Other heat stable materials include inorganic solids, such as ceramics, glass, alumina, vermiculite, clays such as bentonite, and the like.

Other substrate materials used previously have included cellulosic materials, e.g., paper, tobacco paper and the like. These materials typically require a large amount of aerosol former to be present on the substrate to prevent scorching. The presence of large amounts of aerosol former also tends to promote migration of aerosol former from the substrate to other components of the smoking article.

It would be advantageous to have a substrate for smoking articles, particularly cigarettes, which could be manipulated using conventional cigarette making equipment, and which would hold sufficient aerosol forming material to provide aerosol over the 10–12 puff life of a cigarette. It would also be desirable that such a substrate would be stable during storage, i.e., the aerosol former would not appreciably migrate therefrom, to the other parts of the smoking article.

These and other desirable attributes of smoking articles, and particularly cigarettes, are provided by the smoking articles of the present invention, which are described below.

SUMMARY OF THE INVENTION

It has been discovered that polyhydric alcohol (polyol) aerosol forming materials, such as glycerin, propylene glycol, and the like, can be stabilized by the use of certain binders. It has further been discovered that these stabilized mixtures are useful in certain smoking articles, particularly those smoking articles, such as cigarettes employing a short fuel element and a physically separate aerosol generating means for the production of a smoke-like aerosol.

In particular, it has been discovered that aerosol forming materials can be intimately incorporated in a binder to form a stable product of admixture, from which migration of the aerosol former is minimized, particularly over long periods of time, e.g., under typical storage conditions. Such stable mixtures are sprayable, printable, castable, extrudable, or densifiable. Such mixtures may be used with a substrate base or substrate material, or may be used alone to form a substrate for smoking articles. Upon exposure to heat, e.g., from the burning fuel element of a smoking article, the aerosol forming substance is released to form an aerosol.

While not wishing to be bound by theory, it is believed that the aerosol forming materials useful herein serve as plasticizers for the binder. As with all true plasticizers, the aerosol former is a relatively nonvolatile solvent (at room temperatures) for the resinous substance (i.e., the binder) that, when compounded with the binder, increases its flexibility, workability or shock resistance. See, *The Technology of Solvents and Plasticizers,* Chapter 15, "Plasticizers and Plasticization," John Wiley & Sons, New York (1954), the disclosure of which is hereby incorporated herein by reference.

In the stabilized substrate compositions of the present invention the relative amounts of binder and aerosol former depend on the situation in which the substrate composition is used. In general, the ratio of aerosol former to binder is between about 3:1 and about 40:1. When the stabilized composition is used on cut filler, the ratio of aerosol former to binder should be at least about 15:1, and preferably is from about 25–35:1, with a maximum ratio of about 40:1. If formed into a cast sheet, the minimum ratio is about 3:1, the preferred ratio is about 8:1, and the maximum ratio is about 15:1. When the stabilized mixture is printed on a sheet or web substrate, the ratio of aerosol former to binder is generally about 10:1, the maximum ratio is about 15:1, and the minimum ratio is about 3:1.

One preferred form of a substrate according to the present invention utilizes a cut filler material as the substrate base, and applied thereto is a mixture of an aerosol forming material stabilized by a binder. The amount of the aerosol/binder mixture is sufficient to provide adequate aerosol for each of about 8–12 puffs during smoking, and is preferably at least about 15 weight percent of the treated substrate. Preferably, the aerosol forming material and the binder are applied to a cut filler material such as tobacco, reconstituted tobacco, volume expanded tobacco, tobacco paper, or the like. Typically, the cut filler carrying the stabilized mixture is formed into a rod with a circumscribing paper wrapper.

The stabilized cut filler substrate may be prepared by either a one step or a two step process. In the one step process, cut filler material is sprayed with a stabilized admixture of aerosol former and binder together with sufficient water to provide a suitable viscosity for spraying. Thereafter, the treated cut filler material is dried to remove the water, at a temperature sufficiently low so as to prevent significant loss of aerosol forming materials, e.g., at up to about 100° C.

In the two step process, the aerosol forming material (e.g., glycerin) is sprayed on tobacco in a mixer, followed by spraying with an aqueous binder mixture (e.g., alginate) at a sprayable viscosity. Preferably the tobacco/aerosol former mixture is dried by heating at low temperatures (e.g., up to about 100° C.) while the aqueous binder mixture is applied, to drive off the excess water, without substantial loss of the aerosol former. The final moisture content of the cut filler substrate should be from about 8 to 12

Another preferred form of a substrate according to the present invention utilizes a sheet or web material as a substrate base, with a film or coating of a stabilized mixture of an aerosol former and a binder applied to the surface thereof. Normally the mixture includes at least about 15 weight percent of an aerosol former, preferably up to about 97 weight percent, and at least about 3 weight percent of binder. The amount of the aerosol former/binder mixture is sufficient to provide adequate aerosol delivery for about 8–12 puffs during smoking and preferably is at least about 15 weight percent. More preferably, the amount of stabilized aerosol former is about 80 to about 200 weight percent of the treated substrate. The coated sheet material can be gathered to form a rod having a circumscribed wrapper.

The coated sheet material may also be formed into cut filler and made into a rod with a circumscribing wrapper. Preferably the sheet material is a paper material which comprises tobacco, and may also include wood pulp or other filler materials, e.g., for body, strength, or stability. The sheet or web may also comprise a paper, a foil, e.g., aluminum foil, a woven or non-woven web, e.g., glass fiber mat, a film, such as an inert plastic film, or the like. Alternatively the coated sheet material can be shredded into strands, which then can be gathered into rods, as shown in Pryor et al., U.S. Pat. No. 4,889,143 and/or Raker, U.S. Pat. No. 5,025,814.

In one embodiment of a substrate according to the present invention, the base material of the substrate is a mat of glass fibers, preferably formed into an annular tube, circumscribing a core of the stabilized aerosol former/binder composition. The stabilized mixture can be incorporated into (or onto) the glass mat by any means available to the skilled artisan. In the annular tube embodiment, methods such as injection or extrusion may be employed- The annular glass mat tube containing the stabilized mixture would be thermally stable at the temperatures generated in smoking articles employing such a substrate.

In one preferred embodiment of a substrate according to this invention, a tobacco sheet or web, such as reconstituted tobacco or tobacco paper is formed and this sheet is coated, e.g., by spraying or printing with a film composition comprising a mixture of from about 20 weight percent to about 95 weight percent, preferably about 50 to 90 weight percent, most preferably from about 79 weight percent to about 85 weight percent by weight of glycerin, and from about 1 to about 25, preferably from about 2 weight percent to about 20 weight percent, most preferably from about 6 to about 15 weight percent ammonium alginate, such as that available from the Kelco Division of Merck & Co., Inc., San Diego, Calif., under the designation Amoloid LV (low viscosity) or Amoloid HV (high viscosity) or Collatex A/RN (Kelco).

The thus formed tobacco sheet, bearing the aerosol former stabilized with ammonium alginate, can be shredded for use in rods, or formed into cut filler rods, to prepare substrates for cigarettes and other smoking articles. If desired, the tobacco sheet, bearing the aerosol former stabilized with ammonium alginate or other binder can be formed into a gathered or rolled web, and this formed web may be used as a substrate. Other modifications of the manner in which the sheet is employed as a substrate will be apparent to the skilled artisan.

Another composition useful for making a substrate according to the present invention is provided by a mixture of at least about 15 weight percent of an aerosol forming material and at least about 3 weight percent of a binder, and preferably up to about 82 weight percent of one or more filler materials, which can be cast, extruded or otherwise formed into a sheet or film-like material. Preferably the filler materials include tobacco in some form. The filler material may alternatively or additionally comprise an inorganic material, such as calcium carbonate or other inorganic salt.

In general, the stabilized sheet substrate of the present invention comprises an intimate mixture of from about 30 to about 55 weight percent of (i) tobacco (e.g., shredded tobacco laminae, milled tobacco laminae, pieces of tobacco stems, tobacco fines, tobacco dust, or a tobacco extract or other form of processed tobacco), and optionally from about 0 to about 25 weight percent of (ii) one or more filler materials, e.g., inorganic fillers such as precipitated calcium carbonate or the like. The substrate also includes (iii) from about 40 to about 50 weight percent of one or more aerosol forming materials (e.g., polyols, such as glycerin and/or propylene glycol). The substrate also includes (iv) from about 5 to about 8 weight percent of a binding agent, which serves to stabilize the other components, preventing migration of the polyol. An especially preferred binding agent is an alginate, such as ammonium alginate. Advantageously, when tobacco materials are used in the mixture, a cross-linking destruction or releasing agent can be used to liberate the natural binders present in the tobacco (e.g., pectinaceous materials). These released naturally occurring binders may then be used to stabilize the aerosol forming materials. A combination of binders, e.g., released natural tobacco binders and added binders (e.g., alginates) may be used if desired.

The substrate mixture can also include optional flavoring agents (e.g., cocoa, licorice, organic acids, menthol, tobacco based flavors, and the like.) Preferably the flavorants are added in liquid or spray dried form, preferably at the same time as or after the addition of the aerosol forming material to the binder/water mixture. Alternatively, the flavoring agents can be dry mixed with the material at other stages of the process.

The substrate mixture can be cast as a sheet from an aqueous slurry, extruded, molded or otherwise formed into the desired sheet form. Such a substrate can be employed in gathered web form, shredded and gathered into a rod, or used in the form of cut filler. It can be used as the sole substrate of a cigarette or, alternatively, this substrate can be physically mixed with or otherwise employed with other substrate materials, such as tobacco cut filler or inorganic substrates, to form a heterogeneous substrate mixture, or a series of substrate segments. In another embodiment of the present invention, flavoring agents such as menthol are directly incorporated in the substrate composition. One method for directly incorporating menthol involves the formation of an aqueous slurry containing a binder, an aerosol forming material, and a menthol-containing organic or inorganic filler material. An especially preferred organic filler material for use with menthol is activated carbon, treated to retain from about 1 to about 50 weight percent, preferably from about 5 to about 30 weight percent menthol. The carbon/menthol mixture may be prepared by milling activated carbon with solid menthol. During the milling, the menthol vaporizes (or sublimes) and the activated carbon adsorbs and/or absorbs the menthol.

The carbon/menthol slurry generally includes from about 40 to about 90 weight percent of one or more aerosol forming materials (e.g., polyols, such as glycerin and/or propylene glycol). The slurry also includes from about 5 to about 15 weight percent of a binding agent, which serves to stabilize the other components, preventing migration of the flavor material and/or the aerosol forming materials. An especially preferred binding agent is an alginate, such as ammonium alginate.

The slurry may be cast onto a substrate sheet material as described above for the other substrate compositions and air dried under ambient conditions to drive off excess moisture. This substrate composition can be shredded into cut filler or made into a gathered web. This composition as cut filler or gathered web can be made into 7.5 mm diameter paper wrapped rods and cut into 10 mm sections to be used as substrates. Other components can be included in the slurry, e.g., tobacco, inorganic fillers, and the like. As the skilled artisan will appreciate, depending upon the thickness of the slurry, the handling thereof can be varied. For instance, a dilute slurry can be sprayed or printed onto a substrate base material. A slightly thicker slurry can be cast into a sheet form. Still thicker slurries can be extruded and/or densified to form a suitable substrates.

In those preferred embodiments where ammonium alginate is used as a stabilizing binder, it is preferable to add a sequestering agent, such as potassium carbonate, potassium acetate, or other known sequestering agent, to exert some control over the alginate polymerization process.

Regardless of the shape, form or compositional makeup in which it is employed, the substrate material of this invention retains the aerosol forming materials during storage, and releases the materials gradually during smoking. Temperatures as low as from about 180° to 200° C. are typically sufficient to cause a release of the aerosol former, thereby minimizing the amount of fuel necessary for the smoking device.

It has been discovered that low viscosity binders are most useful in those applications where the stabilized mixture is to be sprayed, while high viscosity binders are most useful in those applications where the stabilized mixture is to be cast or otherwise formed into a sheet or web structure. There appears to be no significant difference in the holding power (i.e., as to the binding or retention of the aerosol former) between the high viscosity and the low viscosity binders. As the skilled artisan will appreciate from this disclosure, the most preferred binders are those which will effectively hold a large quantity of aerosol former.

Preferred substrates of the present invention provide tobacco taste, permit little or no migration of the aerosol former, are simple to manufacture, and are easy to incorporate into smoking articles using conventional equipment. The substrates provide adequate quantities of aerosol during use, provide a large number of puffs, with high aerosol content, in the typical cigarette structures employing the substrate. The substrates of the present invention, in various cigarette structures, provide the opportunity to avoid use of metallic heat conductors, such as the aluminum conductive structures used in some prior cigarettes, and to avoid anti-migration measures previously utilized in certain smoking article structures, such as the spacing of the aerosol generating means from the fuel element, and the like. The present substrates are not only stable, but they are lighter in weight than certain prior substrate materials, and provide other advantages as well.

As used herein, the term "aerosol" is meant to include vapors, gases, particles, and the like, both visible and invisible, and especially those components perceived by the smoker to be "smoke-like," formed by the action of heat generated by the fuel element upon materials contained within the aerosol generating means, or elsewhere in the smoking article.

As used herein, the term "carbonaceous" means comprising primarily carbon.

All weight percentages given herein are based on the final composition weights, unless otherwise noted.

DETAILED DESCRIPTION OF THE PREFERRED EMBODIMENTS

As described above, the present invention is particularly directed to a substrate useful in smoking articles, such as the RJR Monograph cigarette and other smoking articles, such as those described in U.S. Pat. Nos. 4,793,365; 4,928,714; 4,714,082; 4,756,318; 4,854,331; 4,708,151; 4,732,168; 4,893,639; 4,827,950; 4,858,630; 4,938,238; 4,903,714; 4,917,128; 4,881,556; 4,991,596; and 5,027,837; U.S. patent application Ser. Nos. 07/642,233, filed Jan. 23, 1991, 07/713,939, filed Jun. 12, 1991, and 07/723,350, filed Jun. 28, 1991, which are hereby incorporated herein by reference. See also, European Patent Publication No. 342,538.

Figure 1:
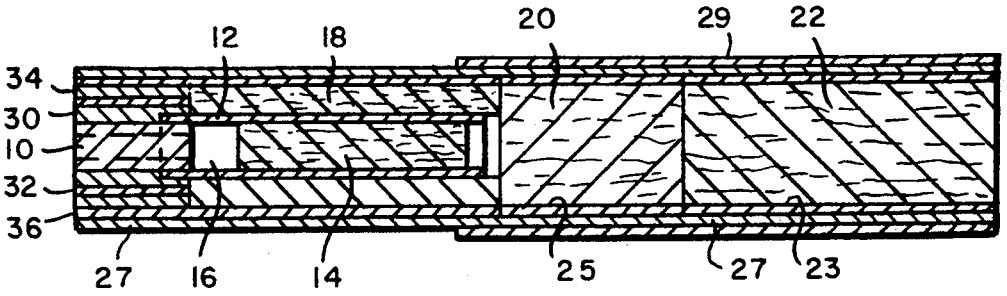
FIG. 1 is a sectional illustration of one configuration of a cigarette having the substrate composition prepared according to the present invention.
Figure 1A:
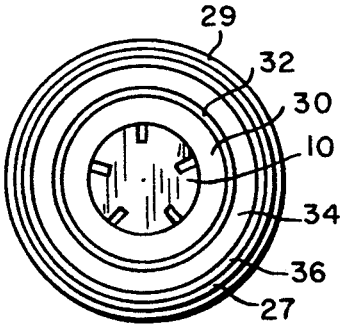
FIG. 1A is an end view of the cigarette shown in FIG. 1.

FIGS. 1 and 1A illustrate a cigarette having a carbonaceous fuel element 10, circumscribed by a jacket comprising alternating layers of glass fibers 30 and 34 and tobacco paper 32 and 36. Located longitudinally behind the fuel element, and in contact with a portion of the rear periphery thereof is a sleeve 12. The sleeve carries the substrate material 14 of the present invention, which contains stabilized aerosol forming materials, and is spaced from the fuel element, forming gap 16. Surrounding the sleeve 12 is a roll of tobacco 18 in cut-filler form. The mouthend piece of the cigarette is comprised of two parts, a tobacco paper segment 20 and a low efficiency polypropylene filter material 22. As illustrated several paper layers 23, 25, 27 and 29, are employed to hold the cigarette and/or its individual components together.

Heat from the burning fuel element is transferred by conduction and convection to the substrate in the sleeve. During puffing the aerosol forming material carried by the substrate is vaporized and then condenses to form a smoke-like aerosol which is drawn through the smoking article, absorbing additional tobacco and other flavors from other components of the smoking article and exits the mouthend piece.

Figure 2:
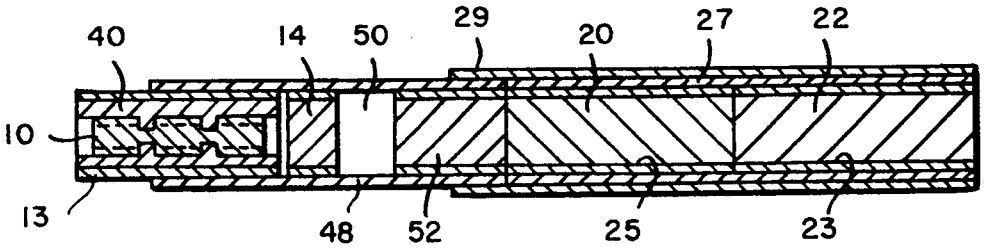
FIG. 2 illustrates in sectional view, another embodiment of a cigarette which may employ the substrate of the present invention.
Figure 2A:
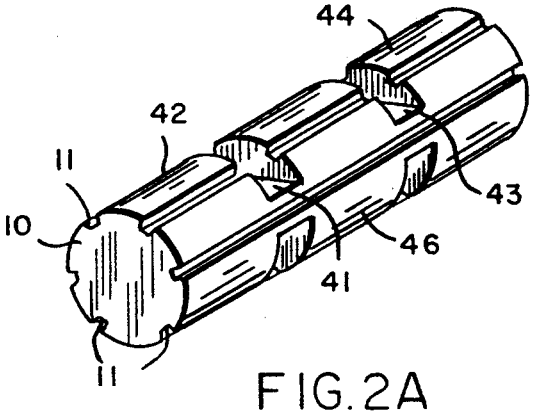
FIG. 2A is a top plan view of the fuel element used in the cigarette shown in FIG. 2.

Referring in detail to FIGS. 2 and 2A, there is respectively illustrated one preferred embodiment of the cigarette of the present invention and a symmetrical fuel element therefor. As illustrated, the cigarette includes a segmented fuel element 10 circumscribed and recessed within a retaining jacket of insulating material 40. The insulating and retaining jacket material 40 comprises glass fibers.

As illustrated in FIG. 2A, the fuel element 10, has a generally cylindrical shape and has several longitudinally extending peripheral channels 11. The fuel element has a segmented design which includes three longitudinally positioned portions or segments, consisting of two end portions 42 and 44 and one intermediate portion 46. When positioned in the cigarette of FIG. 2, one of the end portions 42 or 44 serves as the burning segment, while other 44 or 42 serves as the base segment. Intermediate segment 46 is separated (i.e., isolated) from each of the end segments by two areas of reduced cross-sectional area 41 and 43, which serve as isolation segments.

As shown in FIG. 2, the insulating and retaining jacket 40 circumscribes the longitudinal periphery of fuel element 10 and extends beyond each end of the fuel element, such that the fuel element is recessed within the insulating and retaining jacket. Such placement assists in the retaining function of the jacket. Preferred fibrous (e.g., glass fibers) jackets shrink slightly when exposed to the heat of the burning fuel element, thereby further surrounding the fuel element and retaining it in place.

Situated longitudinally behind the fuel element 10 is an aerosol generating means, which comprises a substrate 14 prepared as described herein. The substrate 14 holds one or more aerosol forming materials and flavor components, which are volatilized by heat generated by the burning of the fuel element. The substrate 14 is positioned within the cigarette at a location remote from the rear end of the fuel element 10. This spaced apart relationship assists in preventing migration of the aerosol forming material(s) from the substrate to the fuel element and assists in preventing the substrate from scorching or burning.

Surrounding the insulating and retaining jacket 40 is an air permeable paper wrapper 13. Wrapper 13 may comprise one layer or it may be prepared from two separate layers, each having different porosity and ash stability characteristics. Circumscribing the insulated fuel element at about the junction of the burning segment 42 and the isolation segment 41, and extending back over the substrate 14 is a non-burning or foil-backed (e.g., aluminum or other metal) paper wrapper 48. Wrapper 48 is preferably a non-wicking material which prevents the wicking of the aerosol forming material(s) on the substrate 14 to the fuel element 10, the insulating jacket 40, and/or from staining of the other components of the front end assembly. This wrapper also minimizes or prevents peripheral air (i.e., radial air) from flowing to the segments of the fuel element disposed longitudinally behind the burning segment, thereby causing oxygen deprivation and preventing excessive combustion. While not preferred, wrapper 48 may extend over the burning end of the fuel element 10 (or beyond the same) and be provided with a plurality of perforations (not shown) to allow controlled radial air flow to the burning segment of the fuel element to support combustion.

Situated longitudinally behind the substrate 14 is a void space 50. Void space 50 acts as a cooling and nucleation chamber wherein the hot volatile materials exiting the substrate cool down and form an aerosol. Void space 50 may be partially or completely filled, e.g., as shown at 52 with tobacco or reconstituted tobacco, e.g., in cut filler form, or with other tobacco materials, e.g., tobacco paper and the like, to contribute additional tobacco flavors to the aerosol.

Positioned at the extreme mouth end of the cigarette is a two part mouthend piece comprising (i) a rod or roll of tobacco, such as tobacco paper 20 and (ii) a low-efficiency filter element 22 including a filter material, such as a gathered web of non-woven polypropylene fibers.

Each of the above described elements of the cigarette of the present invention is generally provided with a paper overwrap, and individual overwrapped segments are typically combined by the use of paper overwraps. Advantageously, the paper overwrap of the substrate is a non-wicking paper. These papers are shown in FIG. 2 as reference numbers 23–26.

In use, the smoker lights fuel element 10 (e.g., using a cigarette lighter) and the burning segment 30 burns to produce heat. During draw, air passes along the periphery of the burning segment 42 (including down channels 11) as well as through the retaining and insulating jacket 40. The drawn air is heated by contacting the burning segment of the fuel element and by heat radiated from the fuel element. The heated air transfers heat by convection to the substrate 14 and this transferred heat volatilizes the aerosol forming and flavor materials carried by the substrate. The volatilized material within the hot drawn air exits the substrate and then cools during passage through void space 50, forming an aerosol. The aerosol passes through the tobacco or tobacco papers 52 and 20 absorbing additional tobacco flavors, and passes through the filter material 22, and into the mouth of the smoker. Since the base portion of the fuel element 44 does not burn during the use of the cigarette, the fuel element remains securely in the cigarette and does not have a tendency to become dislodged from the cigarette during use. When the fuel element self-extinguishes and no longer generates heat, the cigarette is disposed of.

As illustrated in FIGS. 1 & 2, the substrate is positioned behind the fuel element, in a spaced apart relationship relative to the back end of the fuel element so as to have an air space or gap therebetween. This can be accomplished by abutting the substrate against the insulating jacket or by providing a gap or space between the jacketed fuel element and the substrate during manufacture. Such a gap is typically provided to prevent scorching of the substrate materials by the hot gases emanating from the rear of the burning fuel element. This gap also assists in preventing migration of the aerosol forming materials from the aerosol generating means to other components of the cigarette, particularly the fuel element. If desired, the back end of the fuel element and the front end of the substrate may be spaced from about 1 mm to about 10 mm apart, preferably from about 2 mm to about 5 mm apart.

As illustrated in FIG. 2, another void space may also be provided immediately behind the substrate. Such a void space can provide a zone for aerosol formation, and is preferably from about 1 to about 20 mm in length. Such an aerosol forming zone is typically located forward of any tobacco cut filler, tobacco paper or the like, so that the aerosol may pass therethrough and absorb tobacco flavors.

Figure 3:
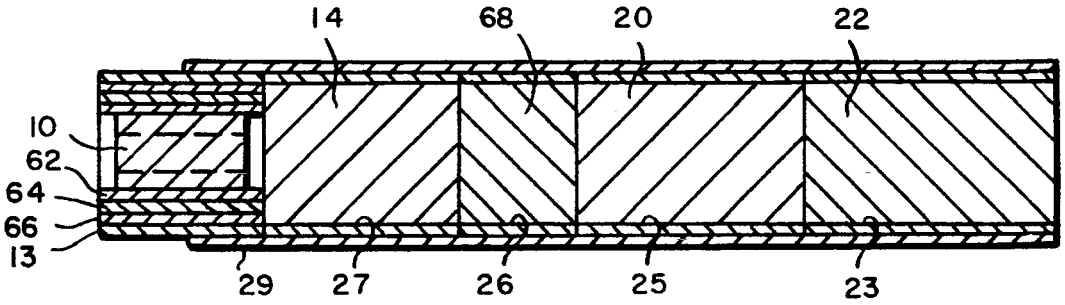
FIG. 3 illustrates in sectional view, another embodiment of a cigarette which may employ the substrate of the present invention.
Figure 3A:
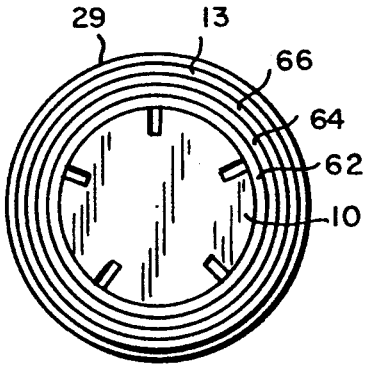
FIG. 3A is an end view of the cigarette shown in FIG. 3.

FIG. 3 illustrates another embodiment of a cigarette which can utilize the substrates of the present invention. As illustrated, a multi-part insulating and retaining jacket circumscribes the longitudinal periphery of fuel element 10 and extends beyond each end of the fuel element, such that the fuel element is recessed within the insulating and retaining jacket. As illustrated in FIG. 3A, the multi-part insulating jacket comprises alternating layers of C-glass fibers and tobacco paper, arranged as concentric rings emanating outwardly from the fuel element in the following order; (a) C-glass 62; (b) tobacco paper 64; and (c) C-glass 66; and an outer paper wrapper 13.

Situated immediately behind the insulated fuel element 10, i.e., in an abutting end-to-end relationship, is the aerosol generating means, which comprises a substrate 14, prepared as described herein. In this embodiment, which is most preferred, the stabilized nature of the substrate composition, in conjunction with the recessed nature of the fuel element 10 within insulating jacket, are factors which help to prevent migration of the aerosol forming materials out of the aerosol generating means into other components of the cigarette. The substrate 14 holds one or more stabilized aerosol forming materials and optional flavor components, which are volatilized by heat generated by the burning of the fuel element.

The wrapper 13 is an air permeable wrapper, which may comprise one layer or it may be prepared from two separate layers, each having different porosity and ash stability characteristics. Circumscribing the insulated fuel element, at a point about 2 to 8 mm from the lighting end of the cigarette, is a non-burning or foil-backed (e.g., aluminum or other metal) paper wrapper 48. Wrapper 48 is preferably a non-wicking material which prevents the wicking of the aerosol forming material(s) on the substrate 14 to the fuel element 10, the insulating jacket, and/or from staining of the other components of the front end assembly. This wrapper also minimizes or prevents peripheral air (i.e., radial air) from flowing to the portion of the fuel element disposed longitudinally behind its forward edge, thereby causing oxygen deprivation and preventing excessive combustion. While not preferred, wrapper 48 may extend over the burning end of the fuel element 10 (or beyond the same) and be provided with a plurality of perforations (not shown) to allow controlled radial air flow to the burning segment of the fuel element to support combustion.

Situated longitudinally behind substrate 14 is a segment of tobacco paper 68. This tobacco paper generally provides tobacco flavors to the aerosol emitted from the aerosol generating means.

Positioned at the extreme mouth end of the cigarette is a two part mouthend piece comprising (i) a rod or roll of tobacco, such as tobacco cut filler 20 and (ii) a low-efficiency filter element 22 including a filter material, such as a gathered web of non-woven polypropylene fibers.

Each of the above described elements of the cigarette of the present invention is generally provided with a paper overwrap, and individual overwrapped segments are typically combined by the use of paper overwraps. Advantageously, the paper overwrap of the substrate is a non-wicking paper. These papers are shown in FIG. 3 as reference numbers 23–26. A tipping paper 29 is used to join the mouthend piece to the front end assembly.

In use, the smoker lights fuel element 10, e.g., using a cigarette lighter, and the fuel burns to produce heat. During draw, air passes along the periphery of the burning fuel element 10, as well as through the retaining and insulating jacket. The drawn air is heated by contacting the burning segment of the fuel element and by heat radiated from the fuel element. The heated air transfers heat by convection to the substrate 14 and this transferred heat volatilizes the aerosol forming and flavor materials carried by the substrate. The volatilized material forms an aerosol during its progression through the substrate, which aerosol is then drawn through the other components during smoking. The aerosol passes through the tobacco or tobacco papers 68 and 20 absorbing additional tobacco flavors, and passes through the filter material 22, and into the mouth of the smoker.

As described in the illustrated embodiments, the aerosol generating means includes a substrate for carrying the aerosol forming material. The substrates of the present invention typically comprises a base material which serves as a carrier, and a stabilized aerosol forming substance, which is generally referred to herein as the substrate composition. Preferred substrate compositions retain the aerosol forming material when not in use, and release the aerosol forming material during smoking. Most preferably, the substrate base compositions and/or the substrate compositions of the present invention incorporate some form of tobacco. The form of the tobacco can vary, and, if desired, more than one form of tobacco may be employed in the substrate composition.

The stabilized substrate composition of the present invention includes an aerosol forming material (e.g., glycerin) and a binding agent. Tobacco extracts and/or pieces of tobacco laminae can be incorporated into the substrate composition, and/or the substrate composition can be applied to and/or blended with tobacco cut filler. Substrates for cigarettes and other smoking articles are provided by wrapping the final substrate composition and optional base or carrier material, in a paper wrapping material.

To form a stabilized substrate composition, the present invention combines one or more binding agents with one or more aerosol forming materials. Preferred binding agents include the alginates, such as ammonium alginate, propylene glycol alginate, potassium alginate and sodium alginate. The alginates, and particularly the high viscosity alginates, can be employed in conjunction with controlled levels of free calcium ions.

Numerous commercial sources of alginate binders are available worldwide. Some of the U.S. sources include; American Roland Chemical Corp., Farmingdale, N.Y.; Belmont Chemicals, Inc., Passaic, N.J.; Colony Import & Export Corp., Garden City, N.Y.; Food Ingredients, Inc., Fort Lee, N.J.; Grinstead Products, Industrial Airport, Kans.; Gum Technology, Flushing, N.Y.; Gumix International, Fort Lee, N.J.; Kelco, Inc., San Diego, Calif.; Meer Corp., North Bergen, N.J.; Multi-Kem Corp., Ridgefield, N.J.; National Stabilizers, Duarte, Calif.; Orion Group (USA), Ltd., San Jose, Calif.; Pacific Gateway, San Francisco, Calif.; Penta Manufacturing Co., Fairfield, N.J.; Protan, Inc., Portsmouth, N.H.; Sanofi Bio-Indust. Inc., Germantown, Wis.; Skymart Enterprises, San Gabriel, Calif.; Spice King Corp., Culver City, Calif.; TIC Gums, Inc., Belcamp, Md.; Wego Chemical & Mineral Corp., Great Neck, N.Y. and Zumbro, Inc., Hayfield, Minn.

Another preferred class of binders for use herein, either alone, or in admixture with an other binders (e.g., alginates) are the binders naturally occurring in tobacco (e.g., pectins and the like). As used herein, the terms "natural tobacco pectin binders" refers to "liberated" tobacco pectins and includes pectins which have been chemically freed or otherwise liberated from their natural state in tobacco. In other words, the liberated pectins are not bound into the tobacco structure. Thus, the term includes free pectinic or pectic acid, as well as soluble salts such as the sodium, potassium, and ammonium, pectates and pectinates, and insoluble salts such as the calcium and magnesium pectates and pectinates, depending on what method is employed to liberate and obtain them from the naturally occurring insoluble source. See for example, U.S. Pat. No. 3,435,829 to Hind et al., the disclosure of which is hereby incorporated herein by reference.

As described in U.S. patent application Ser. No. 07/769,914, filed 30 September 1991, tobacco may be treated with an agent capable of destroying the alkaline earth metal crosslinks of pectins present within that material. Such an agent commonly is referred to as a "crosslink destruction agent" or a "pectin release agent." One preferred crosslink destruction agent is diammonium hydrogen orthophosphate.

Other useful binding agents include hydroxypropylcellulose such as Klucel H from Aqualon. Co.; hydroxypropylmethylcellulose such as Methocel K4MS from The Dow Chemical Co.; hydroxyethylcellulose such as Natrosol 250 MRCS from Aqualon Co.; methylcellulose such as Methocel A4M from The Dow Chemical Co.; and sodium carboxymethylcellulose such as CMC 7HF and CMC 7H4F from Hercules Inc. Other useful binding agents include starches (e.g., corn starch), guar gum, carrageenan, locust bean gum, and xanthan gum.

Examples of preferred aerosol forming materials include the polyhydric alcohols (e.g., glycerin, propylene glycol, triethylene glycol and tetraethylene glycol), the alipahtic esters of mono-, di-, or poly-carboxylic acids (e.g., methyl stearate, dimethyl dodecandioate and dimethyl tetradecanedioate), Hystar TPF available from Lonza, Inc., and the like, as well as mixtures thereof. For example, glycerin, triethylene glycol and Hystar TPF can be mixed together to form an aerosol forming material. The aerosol forming material can be provided as a portion of the binding agent (e.g., when the binding agent is propylene glycol alginate). Combinations of aerosol forming materials can be employed.

Upon consideration of the teachings provided herein, it is believed that a variety of appropriate combinations of aerosol former and binder can be determined by those having ordinary skill in this art. For example, such a combination can be made by selecting a binder which can stabilize a chosen aerosol former, preferably one which can be solvated (or plasticized) by a chosen aerosol former.

The aerosol forming materials may include volatile or other flavoring agents and tobacco flavor modifiers. Suitable flavoring agents include menthol, vanillin, cocoa, licorice, organic acids, high fructose corn syrup, and the like. Tobacco flavor modifiers such as levulinic acid, metal salts (e.g., sodium, potassium, calcium and magnesium) of levulinic acid, and the like, may also be used. Other useful flavoring agents for smoking articles are set forth in Leffingwell et al., *Tobacco Flavoring For Smoking Products* (1972) and in European Patent Publication No. 407,792.

If desired, inorganic materials can be incorporated as fillers in the substrate compositions of the present invention. Such inorganic materials often have a fibrous, flake, crystalline, amorphous, hollow or particulate form. Examples of useful inorganic filler materials include calcium carbonate, calcium sulfate particles, magnesium oxide, magnesium hydroxide, perlite, synthetic mica, vermiculite, clays, thermally stable carbon fibers, zinc oxide, dawsonite, low density hollow spheres of calcium carbonate, glass spheres, glass bubbles, thermally stable carbon microspheres, alumina, calcium carbonate agglomerated using a carbonaceous component, calcium carbonate agglomerated using an organic material, low density processed calcium carbonate and the like. Typically, the substrate compositions of the present invention are provided by forming an aqueous slurry comprising the aerosol forming material, the binding agent and any other components of the substrate composition. This composition may then be formed into a useful substrate for cigarettes and other smoking articles by any processing methods available to the skilled artisan. Several preferred methods include; (1) spraying the stabilized aerosol former/binder mixture onto a substrate base material, such as tobacco cut filler, or the like; (2) printing or otherwise forming a film of the stabilized aerosol former/binder mixture onto a solid base material, such as reconstituted tobacco paper, other papers (e.g., wood pulp containing materials) and the like; (3) by casting a slurry comprising the stabilized aerosol former/binder mixture and one or more filler materials, e.g., an inorganic filler (e.g., $CaCO_3$) and/or an organic filler (e.g., tobacco) into a sheet, and drying the cast material to form a relatively, dry workable sheet; (4) extruding a relatively thick slurry into discretely shaped particles, which may also include one or more passageways or channels therein or thereon, for modification of the surface area; and/or (5) a densified product, wherein an extruded stabilized mixture is treated to one or more processes which increase the density thereof, e.g., by the application of centrifugal force. See, for example U.S. Pat. No. 4,893,639 to White.

Other materials, such as calcium acetate, potassium carbonate, pH control agents, urea, amino acids, potassium chloride and/or calcium hydroxide, can be incorporated into the castable slurry, if desired. Techniques and equipment for forming substrates of this type by spraying, printing, casting, extruding and/or densifying are all commercially available, and will be readily apparent to the skilled artisan.

When ammonium alginate binders are employed in the cast sheet type compositions of the present invention, sequestering agents may preferably be added thereto. Sequestering agents (e.g., diammonium hydrogen orthophosphate, sodium citrate, potassium carbonate, potassium citrate, potassium hexametaphosphate, tetrasodium pyrophosphate, and the like) are typically incorporated into the substrate composition slurry in amounts sufficient to control the free calcium ion concentration in the slurry.

The formed substrate material can be dried at ambient temperatures or at slightly elevated temperatures, sufficient to drive off excess water, but without driving off desired components, e.g., the aerosol forming materials, flavor components, and the like. If desired, an aqueous solution of calcium salts can be applied to the substrates after formation.

The most preferred substrate compositions of the present invention have some form of tobacco incorporated therein during manufacture. The tobacco can have a variety of forms, including tobacco extracts, tobacco fines or dust, shredded or comminuted tobacco laminae, tobacco stems, volume expanded tobacco filler and other processed forms of tobacco, and the like, and combinations thereof.

One form of tobacco especially useful herein is tobacco cut filler (e.g., strands or shreds of tobacco filler having widths of about 1/15 inch to about 1/40 inch, and lengths of about ¼ inch to about 3 inches). Tobacco cut filler can be provided in the form of tobacco laminae, volume expanded or puffed tobacco laminae, processed tobacco stems including cut-rolled or cut-puffed stems, or reconstituted tobacco material.

Processed tobaccos, such as those described in U.S. Pat. No. 5,025,812 to Fagg et al., or U.S. Pat. Nos. 4,065,775 to Fagg and 5,131,414 to Fagg et al. can also be employed. Reconstituted tobacco material can be provided using cast sheet techniques such as those provided in U.S. patent application Ser. No. 4,099,864 to Young et al. or by papermaking techniques, such as those described in U.S. Pat. Nos. 4,962,774 to Thomasson et al. and 4,987,906 to Young et al., as well as in U.S. patent application Ser. Nos. 07/647,329, filed Jan. 28, 1991; or extrusion techniques, such as are described in U.S. Pat. No. 4,821,749 to Toft et al.; or-by volume expansion techniques, such as those described in U.S. Pat. No. 5,095,922 to Johnson et al. Other reconstituted tobacco materials useful in the cigarettes of the present invention are prepared using processes described in U.S. patent application Ser. No. 07/710,273, filed Jun. 4, 1991.

Cut filler, prepared as described herein as a substrate, is generally incorporated into the cigarette as a cylindrical roll or charge of tobacco material which is wrapped in a circumscribing paper wrapper. Tobacco cut filler can be provided as a roll in a paper wrapper using cigarette rod making techniques and apparatus which are well known by the skilled artisan.

Another form of tobacco useful herein is tobacco paper. For example, a web of tobacco paper available as P-144-GNA from Kimberly-Clark Corp. can be gathered into a cylindrical segment in a manner set forth in Example 2 of U.S. Pat. No. 4,807,809 to Pryor et al.

Another form of tobacco useful herein is finely divided tobacco material. Such a form of tobacco includes tobacco dust and finely divided tobacco laminae. Typically, finely divided tobacco material is carried by the substrate which is positioned within the aerosol generating means. However, finely divided tobacco material also can be incorporated into the fuel element.

Another form of tobacco useful herein is tobacco extract. Tobacco extracts are typically provided by extracting a tobacco material using a solvent such as water, carbon dioxide, sulfur hexafluoride, a hydrocarbon such as hexane or ethanol, a halocarbon such as a commercially available Freon, as well as other organic and inorganic solvents. Tobacco extracts can include spray dried tobacco extracts, freeze dried tobacco extracts, tobacco aroma oils, tobacco essences and other types of tobacco extracts. Methods for providing suitable tobacco extracts are set forth in U.S. Pat. Nos. 4,506,682 to Mueller, 4,986,286 to Roberts et al., 5,005,539 to Fagg, 5,060,669 to White et al., 5,121,757 to White et al., and 5,131,415 to Munoz et al., and European Patent Publication No. 338,831; and U.S. patent application Ser. Nos. 07/452,175, filed Dec. 18, 1989, 07/536,250, filed Jun. 11, 1990, 07/680,207, filed Apr. 4, 1991, 07/709,959, filed Jun. 4, 1991, 07/710,273, filed Jun. 4, 1991, and 07/717,457, filed Jun. 19, 1991.

Also useful are flavorful tobacco compositions such as those described in U.S. Pat. No. 5,016,654 to Bernasek et al. Another form of tobacco is enzymatically treated tobacco extract. This extract is described in U.S. patent application Ser. Nos. 07/721,860, filed Jun. 21, 1991, and 07/746,252, filed Aug. 15, 1991.

Preferred substrate compositions of the present invention normally include at least about 15, usually at least about 20, often at least about 25, frequently at least about 30, and sometimes at least about 40 weight percent aerosol forming material. Typically, the substrate composition includes up to about 70, and usually up to about 60 weight percent aerosol forming material. The substrate composition also typically includes up to about 20, preferably about 3 to about 15 weight percent binding agent; and up to about 80 percent preferably about 40 to about 75 weight percent filler component in particular, the filler component can include an organic filler material (e.g. tobacco dust or milled tobacco laminae) and/or inorganic filler materials (e.g., precipitated calcium carbonate).

Optionally, an amount of flavoring agent sufficient to provide the desired flavor characteristics to the substrate composition can be incorporated into the substrate material. Similarly, if desired, a carbonaceous material (e.g., pyrolyzed alpha cellulose) can be incorporated into the substrate material, frequently up to about 10 weight percent, based on the total dry weight of the substrate material. However, such carbonaceous material is not a necessary component of the substrate material, and the substrate material can be absent of such carbonaceous material. While not necessary in most smoking articles, the substrate composition can be combustible, and/or it can be blended with other combustible substrate materials.

One preferred substrate of the present invention thus comprises an intimate mixture of (i) tobacco (e.g., shredded tobacco laminae, milled tobacco laminae, pieces of tobacco stems, tobacco fines, tobacco dust, or a tobacco extract or other form of processed tobacco), and optionally (ii) inorganic filler material. The substrate further includes a relatively high level of a stabilized aerosol forming . material, e.g., a polyol, such as glycerin and a binding agent, in order to maintain the components of the substrate composition together. An especially preferred binding agent is an alginate, such as ammonium alginate.

This tobacco containing substrate also can include certain flavoring agents (e.g., cocoa, licorice, organic acids, menthol, and the like) in intimate contact therewith. The tobacco containing substrate can be cast as a sheet from an aqueous slurry, or provided in extruded form. Such a tobacco containing substrate can be a form of reconstituted tobacco, and can be employed individually as the sole substrate material of the cigarette. Alternatively, such a tobacco containing substrate can be physically mixed with (e.g., blended) or otherwise employed with other substrate materials, such as tobacco cut filler, or with inorganic substrate materials.

Another preferred embodiment of the present invention includes flavoring agents such as menthol, directly incorporated in the substrate composition. In one embodiment the stabilized sheet substrate advantageously comprises an intimate mixture of from about 30 to about 55 weight percent of tobacco (e.g., shredded tobacco laminae, milled tobacco laminae, pieces of tobacco stems, tobacco fines, tobacco dust, or a tobacco extract or other form of processed tobacco), and from about 1 to about 25 weight percent, preferably from about 2 to about 15 weight percent, and most preferably from about 5 to about 8 weight percent of one or more organic filler materials, such as activated carbon, non-activated carbon, or similar organic fillers. The preferred organic filler material, activated carbon, preferably contains from about 1 to about 50 weight percent menthol, preferably from about 5 to about 30 weight percent menthol. The substrate also includes from about 40 to about 90 weight percent of one or more aerosol forming materials (e.g., polyols, such as glycerin and/or propylene glycol). The substrate also includes from about 5 to about 15 weight percent of a binding agent, which serves to stabilize the other components, preventing migration of the flavor material and/or the aerosol forming materials. An especially preferred binding agent is an alginate, such as ammonium alginate.

The menthol containing substrate can be cast as a sheet from an aqueous slurry, or provided in extruded form. Such a menthol containing substrate can be applied e.g., cast onto a reconstituted tobacco sheet, or be physically mixed with (e.g., blended) or otherwise employed with other substrate materials, such as tobacco cut filler, or with inorganic substrate materials.

As discussed above, the substrate compositions of the present invention can be blended with or otherwise applied to tobacco, in any form, especially cut filler. The type of tobacco can vary, and can include flue cured Burley, Maryland and Oriental tobaccos, as well as the rare and specialty tobaccos, and blends thereof. Such tobacco cut filler can be provided in the form of tobacco laminae: volume expanded or puffed tobacco laminae: processed tobacco stems such as cut-rolled or cut-puffed stems: reconstituted tobacco materials, such as (i) deproteinated tobacco materials described in U.S. Pat. Nos. 4,887,618 to Bernasek et al. and 4,941,484 to Clapp et al. (ii) a phosphate-containing reconstituted tobacco material described in U.S. Pat. Nos. 3,353,541 and 3,420,241 to Hind et al. and 3,386,449 to Hind, 4,987,906 to Young et al. and 5,099,864 to Young et al. (iii) a reconstituted tobacco material described in U.S. Pat. No. 4,962,774 to Thomasson et al. and *Tobacco Encyclopedia,* edited by Voges, p. 389, TJI (1984), (iv) the reconstituted tobacco materials described in U.S. Pat. Nos. 5,056,537 to Brown et al. and 5,074,321 to Gentry et al. or blends thereof.

The substrate materials of the present invention can be cased and top dressed as is conventional during various stages of cigarette manufacture. For example, flavoring agents can be applied to the substrate material as is commonly performed when cigarette cut filler is processed. Suitable flavoring agents include vanilla, cocoa, licorice, menthol, and the like. Flavor modifying agents can be applied to the substrate material. A flavor modifying agent in the form of levulinic acid can be applied to the substrate composition (e.g., in amounts ranging from about 0.01 to about 2 percent, normally from about 0.2 to about 0.6 percent based on the dry weight of the substrate material). Another flavor modifying agent in the form of potassium carbonate can be applied to the substrate material (e.g., in amounts of less than about 5 percent normally about 2 to about 3 percent based on the dry weight of the substrate material).

Aerosol forming materials and humectants such as glycerin and propylene glycol can be applied to the substrate material after formation. Such components may be applied to the substrate composition in the manner conventionally used to apply casing and top dressing components, but in any desired amount. While not wishing to be bound by theory, it is believed that such additional casing or top dressing-type components, over time, can be come bound or stabilized by the binder on or in the substrate.

The remaining components of the cigarette (or smoking article) also advantageously contain one or more forms of tobacco. For instance, tobacco can be incorporated into and/or around the fuel element. Similarly, tobacco can be positioned within the mouthend piece in a variety of fashions so that various flavorful tobacco components are transferred to the aerosol. The type and form of tobacco employed in these various segments of the smoking article can vary, and includes flue-cured, Burley, Maryland and Oriental tobaccos, the rare and specialty tobaccos, as well as blends thereof.

The fuel elements employed herein should meet three criteria; (1) they should be easy to ignite, (2) they should supply enough heat to produce aerosol for about 5–15, preferably about 8–12 puffs; and (3) they should not contribute off-taste or unpleasant aromas to the cigarette. Fuel elements prepared from a combustible composition comprising carbon and a binder, or carbon, tobacco and a binder are preferred, but other combustible compositions may be used.

If desired, a non-burning filler material such as calcium carbonate, agglomerated calcium carbonate, or the like, may be added to the fuel composition to assist in controlling the calories generated by the fuel element during combustion, by reducing the amount of combustible material present therein. The filler material typically comprises less than about 50 weight percent of the fuel composition, preferably less than about 30 weight percent, and most preferably from about 5 to about 20 weight percent. See, U.S. patent application Ser. No. 07/567,520, filed Aug. 15, 1990.

Preferred fuel elements used herein comprise carbonaceous materials. The preferred carbonaceous materials have a carbon content above about 60 weight percent, more preferably above about 70 weight percent, and most preferably above about 80 weight percent. Flavors, tobacco materials, fillers (e.g. clays or calcium carbonate), burn additives, combustion modifying agents, and the like, may be incorporated into the fuel element.

The density of the preferred fuel elements is generally greater that about 0.5 g/cc, preferably greater than about 0.7 g/cc and most preferably greater than about 1 g/cc, but typically does not exceed 2 g/cc. The length of the fuel element, prior to burning, is generally less than about 25 mm, often less than about 17 mm, and is typically about 10–12 mm or less.

Exemplary compositions of carbonaceous fuel elements are set forth in U.S. Pat. Nos. 4,714,082 to Banerjee et al.; as well as in European Patent Publication Nos. 236,992 and 407,892; which are incorporated herein by reference. Other exemplary carbonaceous materials are coconut hull carbons, such as the PXC carbons and the PCB carbons, as well as the experimental carbons available as Lot B-11030-CAC-5, Lot B-11250-CAC-115 and Lot 089-A12-CAC-45, from Calgon Carbon Corp.

Other fuel elements can be provided from comminuted tobacco material, reconstituted tobacco material, heat treated or pyrolyzed tobacco materials, cellulosic materials, modified cellulosic materials, and the like. Exemplary materials are set forth in U.S. Pat. No. 3,931,824 to Miano et al., as well as in U.S. patent application Ser. No. 07/569,325, filed, Aug. 17, 1990, and in Sittig, *Tobacco Substitutes,* Noyes Data Corp. (1976).

One suitable fuel composition comprises from about 60 to about 99 weight percent carbon; from about 1 to about 20 weight percent of a suitable binder; from about 1 to about 5 weight percent of an ammonia releasing compound; and from about 2000 to about 20,000 ppm sodium (Na) as measured using inductively coupled plasma atomic emission spectroscopy (ICP-AES). Compounds capable of releasing ammonia under the burning conditions of the fuel composition include compounds such as urea, inorganic and organic salts (e.g., ammonium carbonate, ammonium alginate, or. mono-, di-, or tri-ammonium phosphate); amino sugars (e.g., prolino fructose or asparigino fructose); amino acids, particularly alpha amino acids (e.g., glutamine, glycine, asparagine, proline, alanine, cystine, aspartic acid, phenylalanine or glutamic acid); di-, or tri-peptides; quaternary ammonium compounds, and the like. These fuel compositions are described in detail in Riggs et al., U.S. patent application Ser. No. 07/722,993, filed Jun. 28, 1991, the disclosure of which is hereby incorporated herein by reference.

The carbonaceous fuel elements for smoking articles of the present invention may be molded, machined, pressure formed or extruded into the desired shape. Molded fuel elements can have channels, slots, grooves or hollow regions therein.

Preferred extruded carbonaceous fuel elements can be prepared by admixing up to 95 parts carbonaceous material, up to 20 parts binder and up to 20 parts tobacco (e.g., tobacco dust and/or a tobacco extract) with sufficient water (or aqueous $Na_2CO_3$ solution) to provide an extrudable mixture. This mixture can then be extruded using a ram, screw or piston type extruder into an extrudate of the desired shape having the desired number of channels or void spaces.

If desired, the fuel element can be at least partially circumscribed by a liner, such as at least one layer of paper, which surrounds the peripheral length of the fuel element (see FIG. 2). As such, the liner is positioned between the fuel element and the inner surface of the insulating and retaining material. Preferably, the one or two layers of liner extend along the length of the inner surface of the insulating and retaining material. Most preferably, the liner completely circumscribes the fuel element and extends along the total length of the inner surface of the insulating and retaining member. The liner most preferably is a tobacco paper (e.g., a tobacco/wood pulp paper available as P-2831-189-AA from Kimberly-Clark) or a carbon containing paper (e.g., a carbon—wood pulp—tobacco stem paper available as P-2540-136E from Kimberly-Clark).

When employed in a cigarette, the fuel element (with or without a liner) is circumscribed by an insulating and/or retaining jacket material. The insulating and retaining material preferably (i) is adapted such that drawn air can pass therethrough, and (ii) is positioned and configured so as to hold the fuel element in place. In some embodiments, the insulating and/or retaining material is compressed around the fuel element, thereby ensuring a good, stable positioning and snug fit of the fuel element therein.

In the cigarettes of the present invention, the fuel element may be recessed within the insulating and/or retaining jacket. The length of the jacket extending beyond each end of the fuel element may be as long or as short as desired for producing various burning and heat transfer characteristics. The jacket may be flush with the ends of the fuel element or it may extend from about 0.5 mm to about 3 mm, preferably from about 1 to 2.5, and most preferably from about 1.5 to 2 mm beyond each end of the fuel element.

The components of the insulating and/or retaining material which surrounds the fuel element can vary. This material is preferably one which has a tendency not to combust or a material which combusts but does not disintegrate. Examples of suitable materials include glass fibers and other materials of the type described in U.S. Pat. No. 5,105,838 to White et al. European Patent Publication No. 339,690; and pages 48–52 of the RJR Monograph, supra.

Examples of other suitable insulating and/or retaining materials are glass fiber and tobacco mixtures such as are described in U.S. Pat. No. 4,756,318 to Clearman et al. and U.S. Pat. Nos. 5,065,776 to Lawson et al. and 5,105,838 to White et al.

Other suitable insulating and/or retaining materials are gathered paper-type materials which are spirally wrapped or otherwise wound around the fuel element. Suitable paper-type materials include treated papers; papers containing carbonaceous materials; tobacco-containing papers; wood pulp papers; sulfate papers; wood pulp/calcium carbonate containing papers; papers containing carbonaceous materials, wood pulp, tobacco and fillers, such as those described in copending U.S.

Pat. No. 3,105,836 to Gentry et al. The paper-type materials can be gathered or crimped and gathered around the fuel element; gathered into a rod using a rod making unit available as CU-10 or CU2OS from Decoufle s.a.r.b., together with a KDF-2 rod making apparatus from Hauni-Werke Korber & Co., KG, or the apparatus described in U.S. Pat. No. 4,807,809 to Pryor et al.; wound around the fuel element about the longitudinal axis of the fuel element; or provided as longitudinally extending strands of paper-type sheet using the types of apparatus described in U.S. Pat. Nos. 4,889,143 to Pryor et al. and 5,025,814 to Raker, the disclosures of which are incorporated herein by reference.

Examples of paper-type sheet materials are available as P-2540-136-E carbon paper and P-2674-157 tobacco paper from Kimberly-Clark Corp.; and preferably the longitudinally extending strands of such materials (e.g., strands of about 1/32 inch width) extend along the longitude of the fuel element. The fuel element also can be circumscribed by tobacco cut filler (e.g., flue-cured tobacco cut filler treated with about 2 weight percent potassium carbonate). The number and positioning of the strands or the pattern of the gathered paper is sufficiently tight to maintain, retain or otherwise hold the fuel element within the cigarette.

As illustrated in FIGS. 1–3, the insulating and/or retaining material which surrounds the fuel element is circumscribed by a paper wrapper. This paper wrapper may comprise one or two layers, which may vary in air permeability and ash stability characteristics. Papers having these characteristics are described in U.S. Pat. No. 4,938,238 to Barnes et al. and U.S. Pat. No. 5,105,837 to Barnes et al. One example of a suitable paper wrapper is available as P-850-63-5 from Kimberly-Clark Corp. A portion of this wrapper is in turn circumscribed by a second or outer paper wrapper. An example of a suitable outer paper wrapper is available as P-850-61-2 from Kimberly-Clark Corp. Another suitable paper wrapper is available as P-3122-153 from Kimberly-Clark Corp.

The outer paper wrapper most preferably is a paper which exhibits a propensity not to burn (i.e., due to a very low porosity and/or due to chemical treatment), and preferably does not circumscribe the inner paper wrapper(s) for a length of about 2 mm to about 8 mm, more preferably about 3 mm to about 6 mm, from the extreme lighting end of the cigarette. The outer paper wrapper also circumscribes at least a portion of the length of the aerosol generating means. The outer wrapper acts to assist in preventing the fuel element from burning to any significant degree beyond its forward end. If necessary or desired, the papers employed near the fuel element, particularly those paper wrappers which are positioned outward from the non-burning portion of the fuel element can be coated with burn retardants, such as aqueous solutions of calcium chloride or diammonium hydrogen orthophosphate.

In most embodiments of the present invention, the combination of the fuel element and the substrate (also known as the front end assembly) is attached to a mouthend piece; although a disposable fuel element-/substrate combination can be employed with a separate mouthend piece, such as a reusable cigarette holder. The mouthend piece provides a passageway which channels vaporized aerosol forming materials into the mouth of the smoker; and can also provide further flavor to the vaporized aerosol forming materials. Typically, the length of the mouthend piece ranges form 40 mm to about 85 mm.

Advantageously, the length of the mouthend piece is such that (i) the burning portion of the fuel element is kept well away from the fingers of the smoker; and (ii) hot vaporized aerosol forming materials have sufficient time to cool before reaching the mouth of the smoker. It is often highly desirable to provide a void space within the mouthend piece immediately behind the aerosol generating means. For example, a void space extending at least about 10 mm along the length of the smoking article may be provided immediately behind the aerosol generating means and forward of any tobacco cut filler, tobacco paper or filter segments.

A segment of gathered tobacco paper or tobacco cut filler (or the like) can be incorporated in the mouthend piece. Such a segment can be positioned directly behind the substrate or spaced apart therefrom. A segment of gathered carbon paper can be incorporated into the mouthend piece, particularly in order to introduce menthol flavor to the aerosol. Suitable gathered carbon paper segments are described in European Patent Publication No. 432,538. If desired, a segment including a gathered web of non-woven polypropylene or polyester in intimate contact with a water soluble tobacco extract can be incorporated into the mouthend piece. Such a segment is described in U.S. Pat. Nos. 5,076,295 to Saintsing and 5,105,834 to Saintsing et al.

Suitable mouthend pieces normally are inert With respect to the aerosol forming material, offer minimum aerosol loss as a result of condensation or filtration, and are capable of withstanding the temperatures experienced using use of the smoking article. Exemplary mouthend pieces include plasticized cellulose acetate tubes, such as is available as SCS-1 from American Filtrona Corp.; polyimide tubes available as Kapton from E. I. dupont de Nemours; paperboard or heavy paper tubes; and aluminum foil-lined paper tubes.

The tubular mouthend piece is positioned in an abutting end-to-end relationship with the front end assembly of the cigarette, i.e., the fuel element and substrate combination. Preferably, the cross-sectional shape and dimensions of the mouthend piece are essentially identical to those of the front end assembly. The front end assembly and the combination of the mouthend segments are attached to one another using a circumscribing tipping paper.

The extreme mouth end region of the smoking article preferably includes a filter element or tip, partially for aesthetic reasons. Preferred filter elements are low efficiency filter elements which do not interfere appreciably with aerosol yields. Suitable filter low efficiency filter elements which do not interfere appreciably with aerosol yields. Suitable filter materials include low efficiency cellulose acetate or polypropylene tow, baffled or hollow molded polypropylene materials, gathered webs of non-woven polypropylene materials, or gathered webs of cellulose acetate or paper. Suitable filter elements can be provided by gathering a non-woven polypropylene web available as PP-100-F from Kimberly-Clark Corp. using the filter rod forming apparatus described in Example 1 of U.S. Pat. No. 4,807,809 to Pryor et al.

The entire length of the smoking article, or any portion thereof, can be overwrapped with cigarette paper. Preferred papers of the FIG. 1 type cigarettes, e.g., which circumscribe the heat conducting member, should not openly flame during use of the smoking article, should have controllable smolder properties, and should produce a gray ash. Exemplary, cigarette papers of this type are described in U.S. Pat. No. 4,779,631 to Durocher et al. and European Patent Publication No. 304,766. Suitable paper wrappers are available as P-1981-152, P-1981-124 and P-1224-63 from Kimberly-Clark Corp. Suitable papers for the FIG. 2 and 3 type cigarettes include Kimberly-Clark's P-2831-189-AA and P-3122-153. Tipping paper can circumscribe the extreme mouth end of the smoking article. Suitable tipping papers are non-porous tipping papers treated with "non-lipsticking" materials, and such papers will be apparent to the skilled artisan.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLE 1

GENERAL TECHNIQUES

The stabilized substrate compositions of the present invention are prepared by the following general techniques.

The binder, e.g., ammonium alginate, is first admixed with an excess amount of water (e.g., about 70:1 (parts) water to binder, for approximately five minutes, to fully hydrate the same. Next, the aerosol forming material, or mixture of such materials, e.g., glycerin and optional flavorants, is added to the aqueous alginate slurry, and stirred to blend the same intimately. If ammonium alginate is employed as the binder, one or more sequestering agents, e.g., aqueous $K_2CO_3$, or the like, may be added to the slurry, if necessary or desired. Finally, dry ingredients, which may be first blended together (if desired) are added, e.g., precipitated $CaCO_3$ and/or tobacco. Stirring is continued to form an intimate admixture, in aqueous slurry form.

The final slurry may be further diluted with water to form a sprayable or printable mixture. Such mixtures are then applied to appropriate substrate base materials, e.g., tobacco cut filler, tobacco paper sheets, and the like. If desired, the undiluted slurry may be cast onto an appropriate surface, e.g., a high density polyethylene sheet, in strips of about 2 inches ×3 inches (50.8 mm×76 mm) at at thickness ranging from about 0.010 to 0.080 inches (about 0.25 mm to 2.0 mm) and air dried. The resulting cast sheet may be shredded, e.g., at about 32 cuts per inch, and used as a substrate, e.g., in cut filler form, or blended with tobacco cut filler or other substrate materials to form a final substrate.

EXAMPLE 2

An aqueous slurry is prepared from the following ingredients:

| | |
|---|---|
| ammonium alginate Kelco HV | 6.0 wt. percent |
| glycerin | 45.0 wt. percent |
| $K_2CO_3$ | 1.0 wt. percent |
| $CaCO_3$ | 3.0 wt. percent |
| tobacco (American blend) | 45.0 wt. percent |

This slurry is cast at a thickness of about 0.04 inches (about 1 mm) onto a polyethylene sheet, air dried, and cut into strips resembling tobacco cut filler. The substrate material is overwrapped with a circumscribing paper wrapper and cut into segments having a diameter of 7.5 mm and a lengths of 10 or 15 mm, both useful as substrates.

EXAMPLE 3

A stabilized substrate composition is prepared in a two step method, by first spray applying 30.5 parts of a 1:1 water glycerin solution onto 69.5 parts reconstructed tobacco cut filler. The treated tobacco is then dried using a laboratory Master Heat Gun (Model No. HG-75/B from the Master Appliance Corp. of Racine, Wis.) at an air temperature of about 90° C. for sufficient time to provide a final moisture content of from about 12–15%.

Subsequently, a binder solution consisting of a 99:1 aqueous ammonium alginate (Kelco Co. Amoloid LV) is spray applied to the dried tobacco to yield a substrate product consisting of 1 part binder and 99 parts tobacco and glycerin (based on dry weight). This mixture is dried with the Master Heat Gun at an air temperature of about 90° C. to a produce a substrate composition having a final moisture content of from about 8–12%.

EXAMPLE 4

A stabilized substrate is prepared in a one step method by spray applying an aqueous mixture consisting of 30 parts glycerin and 1 part Amoloid LV ammonium alginate binder (with sufficient water to make a sprayable mixture) onto 69 parts American blend tobacco cut filler. The treated tobacco is then dried using a laboratory Master Heat Gun at an air temperature of about 90° C. for sufficient time to provide a substrate composition having a final moisture content of from about 8–12%.

EXAMPLE 5

A. The two-step procedure of Example 3 is repeated, using volume expanded tobacco as the substrate base material, to form a substrate composition consisting of 30 parts glycerin, 1 part Amoloid LV binder and 69 parts tobacco.

B. The one-step procedure of Example 4 is repeated, using volume expanded tobacco as the substrate base material, to form a substrate composition consisting of 30 parts glycerin, 1 part Amoloid LV binder and 69 parts tobacco.

EXAMPLE 6

An aqueous slurry is prepared from the following ingredients:

| | |
|---|---|
| ammonium alginate Kelco HV | 11 wt. percent |
| glycerin | 89 wt. percent |

This slurry is printed onto a sheet of Kimberly-Clark's P3122-109-A16 tobacco paper to a final loading of about 140 percent by weight. The printed paper is dried with heated air (up to about 90° C.), to remove excess moisture, to provide a substrate composition having a final moisture content of about 8–12%.

The substrate material is overwrapped with a circumscribing paper wrapper and cut into segments having a diameter of about 7.5 mm and lengths of 10 and 15 mm, both suitable for use as substrates herein.

EXAMPLE 7

An aqueous slurry is prepared from the following ingredients:

| | |
|---|---|
| ammonium alginate Kelco HV | 10 wt. percent |
| flavor | 18 wt. percent |
| glycerin | 72 wt. percent |

This slurry is printed onto a sheet of Kimberly-Clark's P3122-109-A16 tobacco paper to a final loading of about 140 percent by weight. The printed paper is dried with heated air (up to about 90° C. air temperature), to remove excess moisture, yielding a substrate composition having a final moisture content of about 8–12%.

The substrate material is overwrapped with a circumscribing paper wrapper and cut into segments having a diameter of about 7.5 mm and lengths of 10 and 5 mm, both suitable for use as substrates herein.

EXAMPLE 8

An aqueous slurry is prepared from the following ingredients:

| | |
|---|---|
| ammonium alginate Kelco HV | 6 wt. percent |
| glycerin | 35 wt. percent |
| $CaCO_3$ | 23 wt. percent |
| tobacco (American blend) | 35 wt. percent |
| $K_2CO_3$ | 1 wt. percent |

This slurry is cast at a thickness of about 0.03 inches (about 0.76 mm) onto a polyethylene sheet, air dried, and cut into strips resembling tobacco cut filler. This substrate composition is overwrapped with a circumscribing paper wrapper to a diameter of 7.5 mm and cut into segments having lengths of 10 or 15, both useful as substrates.

EXAMPLE 9

An aqueous slurry is prepared from the following ingredients:

| | |
|---|---|
| ammonium alginate Kelco HV | 9.8 wt. percent |
| glycerin | 39.0 wt. percent |
| $CaCO_3$ | 20.0 wt. percent |
| tobacco (American blend) | 31.2 wt. percent |

The slurry is cast at a thickness of about 0.04 inch (about 1 mm) and air dried. This substrate composition can be shredded into cut filler or made into a gathered web. This composition as cut filler or gathered web can be made into 7.5 mm diameter paper wrapped rods and cut into 10 mm sections to be used as substrates.

EXAMPLE 10

An aqueous slurry is prepared from the following ingredients:

| | |
|---|---|
| ammonium alginate Kelco HV | 6.0 wt. percent |
| glycerin | 60.0 wt. percent |
| $CaCO_3$ | 3.0 wt. percent |
| ball milled tobacco | |

-continued

| | |
|---|---|
| American blend | 25.0 wt. percent |
| diammonium hydrogen phosphate | 1.0 wt. percent |
| flavor (see Ex. 7) | 5.0 wt. percent |

The slurry is cast at a thickness of about 0.04 inch (about 1 mm) and air dried. This substrate composition is shredded into cut filler and made into rods having a diameter of 7.5 mm and a length of 10 or 27 mm, both of which are useful as substrates.

EXAMPLE 11

An aqueous slurry is prepared from the following ingredients:

| | |
|---|---|
| glycerin | 80 wt. percent |
| Kelco HV | 20 wt. percent |

Two segments of paper, Kimberly-Clark's P1976-29-2, are cast with 370% and 375% by weight of the slurry (on dry weight basis). The cast sheets are dried at 50° C. overnight to afford a substrate composition which can be rolled, cut, or shredded into strips for use as substrates.

EXAMPLE 12

An aqueous slurry is prepared from the following ingredients:

| | |
|---|---|
| glycerin | 80 wt. percent |
| Kelco HV | 20 wt. percent |

Two segments of reconstituted tobacco sheet, Kimberly-Clark's P3122-109-A15, are cast with 320% and 240% by weight of the slurry (on dry weight basis). The cast sheets are dried at 50° C. overnight to afford a substrate composition which can be rolled, cut, or shredded into strips for use as substrates.

EXAMPLE 13

An aqueous slurry is prepared from the following ingredients:

| | |
|---|---|
| glycerin | 80 wt. percent |
| Kelco HV | 20 wt. percent |

A segment of aluminum foil is cast with 109% by weight of the slurry (on dry weight basis). The cast sheet is dried at 50° C. overnight to afford a substrate composition which can be rolled, cut, or shredded into strips for use as substrates.

EXAMPLE 14

An aqueous slurry is prepared from the following ingredients:

| | |
|---|---|
| ammonium alginate Kelco HV | 13.5 parts by wt. |
| glycerin | 81.0 parts by wt. |
| PCB-G carbon with 30% menthol | 5.5 parts by wt. |

The carbon/menthol mixture is prepared by ball milling PCB-G activated carbon from Calgon Carbon Corp., Pittsburgh, Pa., with 30 wt. percent solid menthol. During the ball milling process the mixture becomes warm, which causes the menthol to vaporize, and the activated carbon adsorbs and/or absorbs the menthol vapors.

The slurry is cast at a thickness of about 0.04 inch (about 1 mm) onto Kimberly Clark's No. P-3122-109-A16 paper and air dried under ambient conditions to drive off excess moisture. This substrate composition can be shredded into cut filler or made into a gathered web. This composition as cut filler or gathered web can be made into 7.5 mm diameter paper wrapped rods and cut into 10 mm sections to be used as substrates.

EXAMPLE 15

An aqueous slurry based on a ratio of 4 parts water to one part solids is prepared in the following manner:

Water at 180° F. (about 82° C.) is added to a high sheer mixer. Tobacco solids at 61.3 weight percent (containing 10% moisture) are added to the water and thoroughly mixed therewith. Next, 3.8 weight percent dibasic diammonium phosphate is added to the mixture, which is stirred (digested) for 30–45 minutes. Then, 4.2 weight percent of a 30% aqueous ammonium hydroxide solution is added and mixed (digested) for another 30–45 minutes. Finally, 30.7 weight percent glycerin is added and the mixture is stirred an additional 10–15 minutes.

The resulting slurry is cast on a stainless steel belt at a thickness of 0.03 inches (about 0.76 mm) to form a sheet. Air at 200° F. (about 93° C.) is blown over the upper surface of the sheet while steam contacts the underside of the stainless steel belt. The combined heating methods dry the sheet without driving off the aerosol forming materials. The sheet is doctored off the belt. The film may be shredded into cut filler or made into a gathered web, then overwrapped with paper and cut into 7.5 mm diameter by 10–15 mm long substrate sections.

EXAMPLE 16

Example 15 is repeated, with the following ingredients:

| | |
|---|---|
| glycerin | 47 weight percent |
| tobacco solids | 47 weight percent |
| diammonium phosphate dibasic | 3 weight percent |
| 30% ammonium hydroxide | 3 weight percent |

EXAMPLE 17

An aqueous slurry based on a ratio of 4 parts water to one part solids is prepared in the following manner:

Water heated to about 180° F. (about 82° C.) is added to a high sheer mixer. Tobacco solids at 32 weight percent (containing 10% moisture) is added to the water and thoroughly mixed therewith. Next, 2 weight percent dibasic diammonium phosphate is added to the mixture, which is stirred for 30–45 minutes. Then, 2 weight percent of a 30% aqueous ammonium hydroxide solution is added and mixed for 30–45 minutes.

Ammonium alginate (Kelco HV) at 4 weight percent is activated in 180° F. (about 82° C.) water at a 1:15 solids to water ratio.

Glycerin at 60 weight percent is added to the tobacco slurry, followed by the activated ammonium alginate. This mixture is stirred at high shear for 10–15 minutes.

This slurry is cast on a stainless steel belt at a thickness of 0.03 inches (about 0.76 mm) to form a sheet. Air at 200° F. (about 93° C.) is blown over the upper surface of the sheet while steam contacts the underside of the stainless steel belt. The combined heating methods dry the sheet without driving off the aerosol forming materials. The sheet is doctored off the belt. The film may be shredded into cut filler or made into a gathered web, then overwrapped with paper and cut into 7.5 mm diameter by 10–15 mm long substrate sections.

EXAMPLE 17

Example 16 is repeated, with the following ingredients:

| | |
|---|---|
| glycerin | 60 weight percent |
| tobacco solids | 30 weight percent |
| diammonium phosphate dibasic | 2 weight percent |
| 30% ammonium hydroxide | 2 weight percent |
| Kelco HV | 6 weight percent |

EXAMPLE 18

CIGARETTE OF FIG. 1

Fuel Element Preparation

A generally cylindrical fuel element 9 mm long and 4.5 mm in diameter, and having an apparent (bulk) density of about 1.02 g/cc is prepared from about 72 parts hardwood pulp carbon having an average particle size of 12 microns in diameter, about 20 parts of blended tobacco dust including Burley, flue cured and oriental, the dust being approximately 200 Tyler mesh, and 8 parts Hercules 7HF SCMC binder.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 12 microns in diameter.

The finely powdered hardwood carbon is admixed with the tobacco dust, the sodium carboxymethyl cellulose binder, and sufficient water to provide a mixture having a stiff, dough-like paste form.

Fuel elements are extruded using a ram extruder from the paste so as to have 5 equally spaced peripheral slots or grooves, each having a depth of about 0.032 inch and a width of about 0.016 inch. The configuration of the passageways which extend longitudinally through the fuel element is shown in FIG. 1A. The resulting extrudate is dried in air to provide a resilient extrudate, and the extrudate is cut into 9 mm lengths, thereby providing fuel elements.

Substrate and Sleeve Assembly

A metal capsule is manufactured from aluminum using a metal drawing process. The capsule has a length of about 30 mm, an outer diameter of about 4.6 mm, and an inner diameter of about 4.4 mm. One end of the capsule (the fuel element end) is open; and the other end is closed, except for two slot like openings. The closed end of the capsule is modified to have a single opening of about 4 mm in diameter, thereby converting the capsule into a sleeve.

A rod of tobacco cut filler, prepared from the substrate composition described in Example 3, about 4.4 mm in diameter and about 15 mm long is placed in the sleeve, and positioned toward the rear thereof, at least about 4 to 5 mm from the open end (i.e., the front end).

A fuel element is then inserted into the front end of the sleeve to a depth of about 2 mm. As such, the fuel element extends about 7 mm beyond the open end of the sleeve, and the substrate is separated from the rear of the fuel element by about 2 to 3 mm.

Insulating Jacket

A 15 mm long, 4.5 mm diameter plastic tube is overwrapped with an insulating jacket material that is also 15 mm in length. In these cigarette embodiments, the insulating jacket is composed of 2 layers of Owens-Corning C-glass mat, each about 1 mm thick prior to being compressed by the jacket forming machine, and after formation, each being about 0.6 mm thick. Sandwiched between the two layers of C-glass is one sheet of reconstituted tobacco paper, about 0.13 mm thick, and a second sheet of 0.13 mm thick reconstituted tobacco paper overwraps the outer layer of glass. The reconstituted tobacco paper sheet, designated P2674-157 from Kimberly-Clark Corp., is a paper-like sheet containing a blended tobacco extract. The width of the reconstituted tobacco sheets prior to forming are 19 mm for the inner sheet and 26.5 mm for the outer sheet. The final diameter of the jacketed plastic tube is about 7.5 mm.

Tobacco Roll

A tobacco roll consisting of volume expanded blend of Burley, flue cured and oriental tobacco cut filler is wrapped in a paper designated as P1487-125 from Kimberly-Clark Corp., thereby forming a tobacco roll having a diameter of about 7.5 mm and a length of about 22 mm. See U.S. Pat. No. 5,095,922 to Johnson et al. for a preferred volume expanded tobacco process.

Front End Assembly

The insulating jacket section and the tobacco rod are joined together by a paper overwrap designated as P2674-190 from Kimberly-Clark Corp., which circumscribes the length of the tobacco/glass jacket section as well as the length of the tobacco roll. The mouth end of the tobacco roll is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco roll, simultaneously as the drill and the engaged plastic tube are withdrawn from the mouth end of the roll. The cartridge assembly is inserted until the lighting end of the fuel element is flush with the front end of the insulating jacket. The overall length of the resulting front end assembly is about 37 mm.

Mouthend Piece

The mouthend piece includes a 20 mm long cylindrical segment of a loosely gathered tobacco paper and a 20 mm long cylindrical segment of a gathered web of non-woven, melt-blown polypropylene, each of which includes an outer paper wrap. Each of the segments are provided by subdividing rods prepared using the apparatus described U.S. Pat. No. 4,807,809 to Pryor et al.

The first segment is about 7.5 mm in diameter, and is provided from a loosely gathered web of tobacco paper available as P1440-GNA from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as PP-100 from Kimberly-Clark Corp. which is circumscribed by a paper plug wrap available as P1487-184-2 from Kimberly-Clark Corp.

The two segments are axially aligned in an abutting end-to-end relationship, and are combined by circumscribing the length of each of the segments with a paper overwrap available as L-1377-196F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the front end assembly adjacent the mouthend piece with tipping paper.

Use

In use, the smoker lights the fuel element with a cigarette lighter and the fuel element burns. The smoker inserts the mouth end of the cigarette into his/her lips, and draws on the cigarette. The drawn hot air from the fuel element passes through the substrate and volatilizes the stabilized aerosol former, releasing it from the binder. As the volatile materials are drawn toward the smokers mouth, they pick up flavors from the tobacco segments, and also cool, forming a flavorful, visible, smoke-like aerosol. This visible aerosol having tobacco flavor is drawn into the mouth of the smoker.

EXAMPLE 19

CIGARETTE OF FIG. 2

Fuel Element Preparation

A symmetrical fuel element having the configuration substantially of that shown in FIG. 2 is prepared as follows:

A generally cylindrical longitudinally segmented fuel element 12 mm long and 4.8 mm in diameter, and having an apparent (bulk) density of about 1.02 g/cc is prepared from about 89.1 parts hardwood pulp carbon having an average particle size of 12 microns in diameter, 10 parts ammonium alginate (Amoloid HV, Kelco Co.) and 0.9 parts $Na_2CO_3$.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 12 microns in diameter.

The finely powdered hardwood carbon is dry mixed with the alginate binder, and then an 3% percent aqueous solution of sodium carbonate is added to provide an extrudable mixture, having a final $Na_2CO_3$ content of 0.9 parts by weight.

Cylindrical fuel rods (each about 24 inches long) are extruded using a screw extruder from the mixture having a generally cylindrical shape about 4.8 mm in diameter, with six (6) equally spaced peripheral grooves (about 1 mm×1 mm) with rounded bottoms, running from end to end. The extruded rods have an initial moisture level ranging from about 32–34 weight percent. They are dried at ambient temperature for about 16 hours and the final moisture content is about 7–8 weight percent.

The dried cylindrical rods are end trimmed to a length of 22.5 inches using diamond tipped steel cutting wheels. The rods are placed into a rotating drum having a plurality of channels adapted for accepting and retaining each fuel rod. The rods are secured into the channels on the drum by a plurality of thin rubber straps. The drum is rotated past a shaft having a series of spaced, thin, circular, diamond tipped steel blades. Exemplary blades are the 4-inch diameter 100 to 120 grit blades available from the Norton Co. as 1AIR. The blades are positioned on a shaft so as to create the isolation segments along the length of each rod and trim the rod to the correct length for the next operation. The dimensions of the isolation segments are provided by movement of the shaft or by the use of a wobble plate. The drum continues to rotate and the rod is released therefrom.

The cut rod is then placed into another rotating drum having a plurality of channels adapted for accepting and retaining the rod. The rods are secured in the channels on the drum by a plurality of thin rubber straps. The drum is rotated past a shaft having a series of spaced diamond tipped blades positioned to cut through the rod in the desired locations, forming individual fuel elements. The drum continues to rotate to release the cut fuel elements therefrom into a collection bin.

The finished fuel elements are each 12 mm in length, having end segment lengths of 2.5 mm, two isolation segments 1.5 mm in length each, and an intermediate segment 4.0 mm in length. As such, the cross-sectional area of the isolation segments is about 49% of the cross-sectional area of the end segments. Each fuel element weighs about 165 mg.

Front End Preparation

The fuel element is circumscribed by Owens-Corning C-glass fibers. For details regarding the properties of this material see pages 48–52 of the RJR Monograph, supra. The glass fibers are in turn circumscribed by a paper wrapper available from Kimberly-Clark Corp. as P-2831-189-AA, providing a cylinder having open ends for the passage of air therethrough, a length of about 16 mm and a circumference of about 7.5 mm.

Substrate

Any of the substrates identified in Examples 1–13 may be successfully employed herein. One especially preferred substrate is set forth in Example 9.

Mouthend Piece

A paper tube of about 63 mm length and about 7.5 mm diameter is made from a web of paper about 27 mm wide. The paper is a 76 lb. basis weight paper having a thickness of about 0.012 inch, which is available from Simpson Paper Co. as RJR-001. The paper is formed into a tube by lap-joining the paper using a water-based ethylene vinyl acetate adhesive. To prevent any possible aerosol former migration, the inner surface of the tube is coated with Hercon 70 from Hercules, Inc. about 10 mm into the tube and allowed to dry. Then, the once coated inner surface of the tube is again coated, but with an aqueous solution of calcium chloride (to prevent burning), and allowed to dry.

A 10 mm long substrate is inserted into the coated end of the paper tube such that the front face of the substrate is about 3 mm from the front end of the paper tube. The substrate is held in place securely within the paper tube by friction fit. A 10 mm long segment of tobacco cut filler, wrapped in a circumscribing paper wrapper is inserted into the opposite end of the tube. This tobacco segment is pushed into the tube so that the back end of the tobacco is about 10 mm from the extreme mouth end of the tube.

Into the end of the paper tube opposite the substrate is inserted a cylindrical filter element so as to abut the segment of tobacco cut filler. The filter element has a length of about 10 mm and a circumference of about 24 mm. The filter element is provided using known filter making techniques from triacetin plasticized cellulose acetate tow (8.0 denier per filament; 40,000 total denier), and circumscribing paper plug wrap.

Assembly of the Cigarette

The mouthend piece and front end are positioned in an abutting, end-to-end relationship, such that the front face of the substrate is positioned about 3 mm from the back face of the fuel element. The front end and mouthend pieces are held together by a circumscribing paper wrapper which acts as a tipping paper. The paper wrapper is a low porosity paper available as P-850-61-2 from Kimberly-Clark Corp., and circumscribes the entire length of the front end piece except for about a 3 mm length of the front end piece at the extreme lighting end thereof.

The cigarette is smoked, and yields visible aerosol and tobacco flavor (i.e., volatilized tobacco components) on all puffs for about 10–12 puffs. The fuel element burns to about the region thereof where the burning portion meets the isolation portion, and the cigarette self-extinguishes.

EXAMPLE 20

Fuel Element Preparation

A fuel element 12 mm long and 4.8 mm in diameter, and having an apparent (bulk) density of about 1.02 g/cc is prepared from about 78.7 parts hardwood pulp carbon having an average particle size of 12 microns in diameter, 10 parts ammonium alginate (Amoloid HV, Kelco Co.), 1.0 parts $Na_2CO_3$, 10 parts, ball-milled American blend tobacco and 0.3 parts tobacco extract, obtained as described in U.S. patent application Ser. No. 07/710,273, filed Jun. 9, 1991.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 12 microns in diameter.

The finely powdered hardwood carbon is dry mixed with the ammonium alginate binder, and tobaccos, and then a 3% wt. percent aqueous solution of $Na_2CO_3$ is added to provide an extrudable mixture, having a final sodium carbonate level of about 1.0 parts.

Cylindrical fuel rods (each about 24 inches long) are extruded using a screw extruder from the mixture having a generally cylindrical shape about 4.8 mm in diameter, with five (5) equally spaced peripheral grooves (about 1 mm×1 mm) with rounded bottoms, running from end to end. The extruded rods have an initial moisture level ranging from about 32–34 weight percent. They are dried at ambient temperature for about 16 hours and the final moisture content is about 7–8 weight percent. The dried cylindrical rods are cut to a length of 12 mm using diamond tipped steel cutting wheels.

Insulating Jacket

A 16 mm long, 4.5 mm diameter plastic tube is overwrapped with an insulating jacket material that is also 16 mm in length. In these cigarette embodiments, the insulating jacket is composed of 2 layers of Owens-Corning C-glass mat, each about 1 mm thick prior to being compressed by the jacket forming machine, and after formation, each being about 0.6 mm thick. Sandwiched between the two layers of C-glass is one sheet of reconstituted tobacco paper, Kimberly-Clark's P-2831-189-AA, about 0.13 mm thick. A cigarette paper, designated P-3122-153 from Kimberly-Clark, overwraps the outer layer. The reconstituted tobacco paper sheet, is a paper-like sheet containing a blended tobacco extract. The width of the reconstituted tobacco sheets prior to forming are 19 mm for the inner sheet and 26.5 mm for the outer sheet. The final diameter of the jacketed plastic tube is about 7.5 mm.

Frontend Piece

A 12 mm long fuel element is inserted into the insulating jacket to force out the 16 mm long plastic tube. The fuel element is positioned in the jacket so that each end is recessed about 2 mm.

Substrate

Any of the substrates identified in Examples 1–13 may be successfully employed herein. One especially preferred substrate is set forth in Example 9.

Paper Tube

A paper tube about 77 mm length and about 7.5 mm diameter is made from a web of 76 pound basis weight Simpson RJR-001 paper, about 27 mm wide, having a thickness of about 0.012 inch. The RJR-001 paper is formed into a tube by lap-joining the paper using a water-based ethylene vinyl acetate adhesive. The inner surface of the paper tube is coated with a water-based ethylene vinyl acetate adhesive containing ethanol and phosphoric acid, together with the anti-mold preservative Kathon LX-1.5, available from Rohm and Haas. An aluminum foil sheet 37 mm in length is wrapped around a steel rod approximately 6.75 mm in outer diameter and inserted into the end of the paper tube so that one edge of the foil tube is flush with one edge of the paper tube. The steel rod is then removed, leaving the foil laminated to the inner surface of the paper tube.

Assembly of the Cigarette

A 15 mm long 7.5 mm diameter substrate is inserted into the foil-lined end of the paper tube such that the front face of the substrate is about 10 mm from the front end of the paper tube. The substrate is held in place securely within the paper tube by friction fit. A 12 mm long 7.5 mm diameter segment of reconstituted tobacco paper, wrapped in a circumscribing paper wrapper is inserted into the opposite end of the tube. This tobacco paper segment is pushed into the tube so that it abuts the back end of the substrate. Next, a 20 mm long 7.5 mm diameter segment of tobacco cut filler, wrapped in a circumscribing paper wrapper is inserted into the paper tube to abut the reconstituted tobacco paper segment. A 20 mm long 7.5 mm diameter polypropylene web filter element is inserted into the paper tube so that it abuts the segment of tobacco cut filler. A front end piece is inserted into the opposite end of the paper tube so that the-internal end of the insulating jacket abuts the front end of the substrate. The front end piece extends outwardly at least about 6 mm from the front end of the paper tube.

The cigarette is smoked, and yields visible aerosol and tobacco flavor (i.e., volatilized tobacco components) on all puffs for about 10–12 puffs. The fuel element burns to about the region thereof where the burning portion meets the isolation portion, and the cigarette self-extinguishes.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A stabilized substrate composition, comprising an admixture of an aerosol forming substance, in an effective amount to provide a smokeable aerosol, and a binder which stabilizes the aerosol forming substance, wherein the ratio of the aerosol forming substance to the binder is in the range of from about 3:1 to about 40:1, and where the binder comprises an alginate binder.

2. The stabilized composition of claim 1, further comprising sufficient water to be a sprayable composition at room temperature.

3. The stabilized composition of claim 1, further comprising sufficient water to be a printable composition at room temperature.

4. The stabilized composition of claim 1, further comprising sufficient water to be an extrudable composition at room temperature.

5. The stabilized composition of claim 1, further comprising sufficient water to be a castable composition at room temperature.

6. The stabilized composition of claim 5, which further includes one or more sequestering agents.

7. The stabilized composition of claim 5, further comprising a filler material selected from the group consisting of inorganic fillers, organic fillers, and mixtures thereof.

8. The stabilized composition of claim 7, wherein the organic filler material comprises tobacco.

9. The stabilized composition of claim 7, wherein the filler material comprises a mixture of tobacco and an inorganic filler material.

10. The stabilized composition of claim 7, wherein the organic filler material comprises carbon.

11. The stabilized composition of claim 10, wherein the organic filler material further comprises menthol.

12. The stabilized composition of claim 1, 2, 3, 4, 5, 6, 7, 8, 9, 10, or 11, wherein the binder comprises one or more naturally occurring tobacco binders liberated by a cross-link destabilizing agent.

13. The stabilized substrate composition of claim 14, wherein the moisture content of the substrate composition is from about 8 to 12%.

14. The stabilized composition of claim 1, 2, or 3, further comprising a base material to which the stabilized composition has been applied, said base material being selected from the group consisting of organic-based and inorganic-based, mat, web, sheet, shredded, or cut filler materials.

15. The stabilized composition of claim 14, wherein the base material is an inorganic-based material selected from the group consisting of aluminum foil, plastic film, or glass fiber mat.

16. The stabilized composition of claim 14, wherein the base material is an organic-based paper material, in a sheet, mat, web, shredded, or cut filler form.

17. The stabilized composition of claim 14, wherein the organic based material is a paper containing wood pulp.

18. The stabilized composition of claim 14, wherein the organic based material is a paper containing tobacco.

19. A stabilized substrate composition, comprising tobacco cut filler as a base material to which has been applied an admixture comprising a polyhydric alcohol, in an effective amount to provide a smokeable aerosol, and a binder plasticizable by said polyhydric alcohol, wherein the ratio of the polyhydric alcohol to binder is from about 15:1 to about 40:1.

20. The stabilized composition of claim 19, wherein the ratio of polyhydric alcohol to binder is in the range of from about 25:1 to about 5:1.

21. A stabilized composition, comprising a reconstituted tobacco paper sheet as a base material to which has been applied an admixture comprising a polyhydric alcohol, in an effective amount to provide a smokeable aerosol, and a binder plasticizable by said polyhydric alcohol, wherein the ratio of the polyhydric alcohol to binder is from about 3:1 to about 15:1.

22. The stabilized composition of claim 21, wherein the ratio of polyhydric alcohol to binder is in about 10:1.

23. A stabilized substrate composition comprising a glass fiber mat as a base material to which has been applied an admixture comprising a polyhydric alcohol, in an effective amount to provide a smokeable aerosol, and a binder plasticizable by said polyhydric alcohol, wherein the ratio of the polyhydric alcohol to binder is from about 3:1 to about 15:1.

24. The stabilized composition of claim 25, wherein the ratio of polyhydric alcohol to binder is in about 10:1.

25. A stabilized substrate composition, comprising an admixture of a filler material, a polyhydric alcohol aerosol forming material, in an effective amount to provide a smokeable aerosol, and a binder, wherein the ratio of the polyhydric alcohol to the binder ranges from about 15:1 to about 40:1.

26. The stabilized composition of claim 25, wherein the filler material is selected from the group consisting of inorganic filler materials, organic filler materials, and mixtures thereof.

27. The stabilized composition of claim 25 or 26, wherein the filler material comprises tobacco.

28. The stabilized composition of claim 25 or 26, further including a base material with which the stabilized composition has been mixed, said base material being selected from the group consisting of sheet materials, shredded materials, and cut-filler materials.

29. The stabilized composition of claim 28, wherein the ratio of polyhydric alcohol to binder is from about 25:1 to 35:1.

30. A substrate for smoking articles, comprising a base material in the form of a sheet, mat, or webs said base material having a film or coating thereon comprising a stabilized aerosol forming composition comprising an admixture of a polyhydric alcohol aerosol former, in an effective amount to provide a smokeable aerosol, and a binders wherein the weight ratio of the aerosol former to the binder ranges from about 15:3 to 97:3.

31. The substrate of claim 30, wherein the base material comprises a glass fiber mat.

32. The substrate of claim 30, wherein the coated base material is selected from the group of sheet materials consisting of papers, metal foils, and inert plastic films.

33. The substrate of claim 32, wherein the paper sheet materials are selected from the group consisting of wood pulp based papers, tobacco papers, and mixtures thereof.

34. The substrate of claim 32, wherein the metal foil sheet material is an aluminum foil.

35. The substrate of claim 30, 32, 33, 31, or 34, wherein the binder comprises an alginate binder.

36. The substrate of claim 35, wherein the alginate binder comprises ammonium alginate.

37. The substrate of claim 30, 32, 33, 31, or 34, wherein the binder comprises one or more naturally occurring tobacco binders liberated by a cross-link destabilizing agent.

38. The substrate of claim 37, wherein the binder further comprises an alginate binder.

39. A substrate for smoking articles, comprising a tobacco sheet or web, which is coated with a film composition, in an effective amount to provide a smokeable aerosol, comprising a stabilized admixture of from about 20% to about 85% of a polyhydric alcohol aerosol forming material and from about 1% to about 251 % of a binder.

40. The substrate of claim 39, wherein the polyhydric alcohol aerosol forming material ranges from about 50% to 90%, and the binder ranges from about 2% to about 20%.

41. The substrate of claim 40, wherein the polyhydric alcohol aerosol forming material ranges from about 79% to 85%, and the binder ranges from about 6% to about 15%.

42. The substrate of claim 39, 40, or 41, wherein the binder comprises an alginate binder.

43. The substrate of claim 42, wherein the alginate binder comprises ammonium alginate.

44. The substrate of claim 39, 40, or 41, wherein the binder comprises one or more naturally occurring tobacco binders liberated by a cross-link destabilizing agent.

45. The substrate of claim 44, wherein the binder further comprises an alginate binder.

46. A process for forming a substrate for smoking articles, comprising the steps of:

(a) spraying tobacco cut filler with a stabilized admixture comprising an aerosol forming polyhydric alcohol and a binder in sufficient water to provide a suitable viscosity for spraying;

(b) drying the sprayed cut filler material to a final moisture content of from about 8% to 12%, at a temperature sufficient to drive off excess water, but low enough so as to prevent significant loss of aerosol forming material.

47. A process for forming a substrate for smoking articles, comprising the steps of:

(a) spraying a polyhydric alcohol aerosol forming substance on tobacco cut filler material;

(b) thereafter spraying an aqueous binder slurry on the treated tobacco; and (c) drying the twice sprayed cut filler material to a final moisture content of from about 8% to 12%, at a temperature sufficient to drive off excess water, but low enough so as to prevent significant loss of aerosol forming material.

48. A cigarette comprising:

(a) a carbonaceous fuel element less than about 30 mm in length prior to smoking;

(b) a substrate disposed longitudinally behind said fuel element, said substrate comprising a sheet or web material as a substrate base, said base having a film or coating thereon comprising a stabilized aerosol forming composition comprising an admixture of a polyhydric alcohol aerosol former and a binder, wherein the weight ratio of the aerosol former to the binder ranges from about 15:3 to 97:3; and (c) a mouthend piece.

49. The cigarette of claim 48, wherein the coated sheet material of the substrate is selected from the group consisting of papers, metal foils, and inert plastic films.

50. The cigarette of claim 48, wherein the paper sheet materials are selected from the group consisting of wood pulp based papers, tobacco papers, and mixtures thereof.

51. The cigarette of claim 48, wherein the metal foil sheet material is an aluminum foil.

52. The cigarette of claim 48, 49, 50, or 51, wherein the binder comprises an alginate binder.

53. The cigarette of claim 52, wherein the alginate binder comprises ammonium alginate.

54. The cigarette of claim 48, 49, 50, or 51, wherein the binder comprises one or more naturally occurring tobacco binders liberated by a cross-link destabilizing agent.

55. The substrate of claim 54, wherein the binder further comprises an alginate binder.

56. A cigarette comprising:

(a) a fuel element;

(b) a substrate disposed longitudinally behind said fuel element, said substrate comprising a tobacco sheet or web, which is coated with a film composition comprising a stabilized admixture of from about 20% to about 95% of a polyhydric alcohol aerosol forming material and from about 1% to about 25%, of a binder; and (c) a mouthend piece.

57. The cigarette of claim 56, wherein the polyhydric alcohol aerosol forming material ranges from about 50% to 90%, and the binder ranges from about 2% to about 20%.

58. The cigarette of claim 56, wherein the polyhydric alcohol aerosol forming material ranges from about 79% to 85%, and the binder ranges from about 6% to about 15%.

59. The cigarette of claim 56, 57, or 58, wherein the substrate binder comprises an alginate binder.

60. The cigarette of claim 59, wherein the alginate binder comprises ammonium alginate.

61. The cigarette of claim 56, 57, or 58, wherein the binder comprises one or more naturally occurring tobacco binders liberated by a cross-link destabilizing agent.

62. The substrate of claim 61, wherein the binder further comprises an alginate binder.

63. A cigarette comprising:

(a) a fuel element less than about 30 mm in length prior to smoking;

(b) a substrate disposed longitudinally behind said fuel element, said substrate comprising a stabilized aerosol forming admixture comprising at least about 15 weight percent of an aerosol forming material and at least about 3 weight percent of a binder; and (c) a mouthend piece, wherein the substrate binder comprises an alginate binder.

64. The cigarette of claim 63, wherein the substrate composition further comprises up to about 82 weight percent of one or more filler materials, selected from the group consisting of inorganic filler materials, organic filler materials, and mixtures thereof.

65. The cigarette of claim 64, wherein the organic filler material comprises tobacco cut filler.

66. The cigarette of claim 64, wherein the substrate composition further comprises one or more flavor agents.

67. The cigarette of claim 63, wherein the alginate binder comprises ammonium alginate.

68. A cigarette comprising:

(a) a carbonaceous fuel element;

(b) a substrate disposed longitudinally behind said fuel element, said substrate comprising a rod or roll of shredded strands formed from a cast sheet material formed from an intimate mixture of:

(i) from about 30 to about 55 weight percent of tobacco;

(ii) from about 0 to about 25 weight percent of one or more inorganic or organic filler materials;

(iii) from about 40 to about 50 weight percent of one or more polyhydric alcohol aerosol forming materials; and (iv) from about 5 to about 8 weight percent of a binder.

69. A cigarette comprising:

(a) a carbonaceous fuel element;

(b) a substrate disposed longitudinally behind said fuel element, said substrate comprising a rod or roll of gathered paper treated with an intimate mixture of:

(i) from about 30 to about 55 weight percent of tobacco;

(ii) from about 40 to about 50 weight percent of one or more polyhydric alcohol aerosol forming materials; and (iii) from about 5 to about 8 weight percent of a binder.

70. The cigarette of claim 68 or 69, wherein the substrate composition further comprises one or more flavor agents.

71. The cigarette of claim 68 or 69, wherein the substrate binder comprises an alginate binder.

72. The cigarette of claim 71, wherein the alginate binder comprises ammonium alginate.

* * * * *

UNITED STATES PATENT AND TRADEMARK OFFICE

CERTIFICATE OF CORRECTION

PATENT NO. : 5,396,911

DATED : March 14, 1995

INVENTOR(S) : William J. Casey, III et al.

It is certified that error appears in the above-indentified patent and that said Letters Patent is hereby corrected as shown below:

Col. 3, line 40, following "12" should be -- %. --.

Col. 17, line 28, "407,892" should be -- 407,792 --.

Col. 34, line 14, "webs" should be -- web --.

Col. 34, line 19, "binders" should be -- binder, --.

Col. 34, line 47, "251% should be -- 25%.

Signed and Sealed this

Sixth Day of August, 1996

Bruce Lehman

*Attest:*

BRUCE LEHMAN

*Attesting Officer*

*Commissioner of Patents and Trademarks*